United States Patent [19]

Ito

[11] Patent Number: 4,933,725

[45] Date of Patent: Jun. 12, 1990

[54] IMAGE DUPLICATING APPARATUS WITH LOCKING MEANS

[75] Inventor: Masazumi Ito, Osaka, Japan

[73] Assignee: Minolta Camera Kabushiki Kaisha, Osaka, Japan

[21] Appl. No.: 276,962

[22] Filed: Nov. 28, 1988

[30] Foreign Application Priority Data

Nov. 27, 1987 [JP] Japan ..... 62-301317

[51] Int. Cl.[5] ..... G03G 15/00

[52] U.S. Cl. ..... 355/309; 271/9

[58] Field of Search ..... 355/309, 308, 47, 48, 355/50, 51; 271/9, 162, 164

[56] References Cited

U.S. PATENT DOCUMENTS 3,687,540 8/1972 Hashimoto .
4,126,390 11/1978 Connin ..... 355/309 X
4,501,485 2/1985 Tsudaka .
4,568,177 2/1986 Sato et al. .
4,633,405 12/1986 Ito .

FOREIGN PATENT DOCUMENTS 55-50260 4/1980 Japan .
58-182779 10/1983 Japan .

*Primary Examiner*—R. L. Moses
*Attorney, Agent, or Firm*—Burns, Doane, Swecker & Mathis

[57] ABSTRACT

An image duplicating apparatus using a machine management system in combination with a multiple-job automatic document feed module while establishing reasonable compatibility between the respective features of these equipment, having a duplicator module for producing a printed duplicate of an original document held in a predetermined position within the apparatus, a plurality of document supply units each operative to supply an original document therefrom, a document transport assembly for transporting the original document supplied from any of the document supply units to the predetermined position and discharging the original document from the predetermined position after the printed duplicate the original document is reproduced by the duplicator module, and a machine management system comprising a plurality of enabling sections respectively associated with the individual document supply units and each operative to enable the apparatus to operate with an original document supplied from the associated document supply units.

18 Claims, 23 Drawing Sheets

IMAGE DUPLICATING APPARATUS WITH LOCKING MEANS

FIELD OF THE INVENTION

The present invention relates to an image duplicating apparatus of the type having an automatic document feed module as a subsidiary module additional to a main duplicator module and, more particularly, to an image duplicating apparatus having, in addition to such main and subsidiary modules, a machine locking and output counting device adapted to maintain the apparatus in a locked condition unless special unlocking and output count register means is loaded into the device and count the quantity of printed outputs produced.

BACKGROUND OF THE INVENTION

An image duplicating apparatus having an automatic document feed module in addition to a main duplicator module is well known and is in wide use. An automatic document feed module is the apparatus which is operative to automatically feed an original document or successively a plurality of original documents to a predetermined position on the document support table of the duplicator module and withdraw the document or each of the documents from the document support table upon completion of the cycle of copying operation for the document.

An automatic document feed module of the type having a "multiple-job" feature is also known which allows selection of the quantity of printed outputs to be produced for each of a plurality of original documents. Thus, an operator of the duplicating machine having such a type of automatic document feed module may set the module in a manner to produce, for example, three printed outputs for each of a first set of original documents, a single printed output for each of a second set of original documents, and five printed outputs for each of a third set of original documents. With the automatic document feed module set in this fashion, the duplicating apparatus produces printed outputs in quantities respectively preset for individual groups of documents and will thus allow the operator to save the time and labor that would be otherwise necessitated for the production of printed outputs of such diverse quantities.

In the meantime, an image duplicating apparatus is further known which is equipped with a machine locking and output counting device adapted to maintain the apparatus in a locked condition unless a "key/counter", special plug-in unlocking and output count register means, is loaded into the device. When actuated by the key/counter, the locking and output counting device, hereinafter referred to as machine management system, unlocks the duplicating apparatus and is operative to count the quantity of the printed outputs produced after the key counter is loaded into the management system.

In the key/counter for use with such a machine management system are given authorizations for users authorized to use the apparatus so that the authorized users alone are permitted to unlock and use the apparatus. When a cycle of copying operation which may consist of a single printing step or a succession of printing steps is complete, the number of the printing steps repeated and counted by the management system after the key/counter was loaded into the system is registered into the key/counter and is displayed thereon. The number of the printing steps repeated during the cycle of copying operation just terminated is added to the number of the printing steps which had been registered in the key/counter so that the particular bearer of the key/counter is enabled to know the total quantity of the printed outputs which have been produced since the count registered in the key/counter was last reset.

A automatic document feed module having the multiple-job feature as above described is advantageous in that printed outputs can be produced in different quantities for a plurality of groups of original documents. Whether the groups of original documents currently set on the automatic document feed module belong to different users or to one and the same user is however not taken into account in such a multiple-job automatic document feed module. On the other hand, a machine management system of the described nature is useful for enabling each of the authorized users of a single duplicating apparatus to use the apparatus at his own expense for the printed outputs produced through the use of the key/counter which the particular user possesses. Thus, the printed outputs produced through the use of a key/counter in the possession of one authorized user are distinguished from those produced through the use of a key/counter possessed by another authorized user. In other words, an automatic document feed module equipped with a machine management system be capable of distinguishing a group or groups of original documents belonging to one authorized user from a group or groups of original documents belonging to another authorized user of the apparatus.

Where a machine management system is incorporated into an automatic document feed module having multiple-job capabilities, a user desiring to produce duplicates of originals broken down to a plurality of groups, the user will be required to load the key/counter into the management system for one of the groups and thereafter into the management system for another group of original documents. If the user fails to exchange the key/counter from one management system to another and if it happens that a count of printed outputs is stored in the latter, the count in the particular management system in addition to the count stored in the former will be registered into the key/counter. The result is that the user is compelled to be responsible for not only the outputs produced for him or her but also the outputs produced for another user.

SUMMARY OF THE INVENTION

It is, accordingly, an important object of the present invention to provide an improved image duplicating apparatus using a machine management system in combination with a multiple-job automatic document feed module while establishing reasonable compatibility between the respective features of these equipment.

In accordance with a first outstanding aspect of the present invention, there is provided an image duplicating apparatus comprising (a) image reproducing means for reproducing an image on an original document held in a predetermined position within the apparatus, (b) a plurality of document supply means each operative to supply an original document therefrom, (c) document transport means for transporting the original document supplied from any of the document supply means to the predetermined position and discharging the original document from the predetermined position after the image on the original document is reproduced by the image reproducing means, and (d) management means comprising a plurality of enabling means respectively associated with the plurality of document supply means and each operative to enable the apparatus to operate with an original document supplied from the associated document supply means.

In accordance with a second outstanding aspect of the present invention, there is provided an image duplicating apparatus comprising (a) image reproducing means for reproducing an image on an original document held in a predetermined position within the apparatus, (b) a plurality of document supply means each operative to supply an original document therefrom, (c) document transport means for transporting the original document supplied from any of the document supply means to the predetermined position and discharging the original document from the predetermined position after the image on the original document is reproduced by the image reproducing means, (d) management means operable for locking the apparatus in an inoperative condition and comprising a plurality of enabling means respectively associated with the plurality of document supply means and each operative to enable the apparatus to operate with an original document supplied from the associated document supply means unlocking means operable for unlocking the apparatus when brought into engagement with any one of the plurality of enabling means, detecting means for detecting the engagement established between the unlocking means and any of the plurality of enabling means, (e) control means for clearing the inoperative condition of the apparatus when the presence of the unlocking means engaging with the casing of any one of the plurality of enabling means is detected by the detecting means, (f) output producing means for producing a printed output having a printed image reproduced by the image reproducing means from an original document supplied from any of the plurality of document supply means, (g) the unlocking means comprising memory means for storing the accumulated quantity of printed outputs produced by the output producing means for the original documents supplied from the document supply means or document supply means having the casing or casings of the associated enabling means which have been engaged by the locking means after the memory means is reset for the last time, and (h) incrementing means operative to increment the accumulated quantity of printed outputs each time a printed output is produced by the output producing means.

BRIEF DESCRIPTION OF THE DRAWINGS

The features and advantages of an image duplicating apparatus according to the present invention will be more clearly appreciated from the following description taken in conjunction with the accompanying drawings in which.

DESCRIPTION OF THE PREFERRED EMBODIMENT

General Construction of Apparatus

Figure 1:
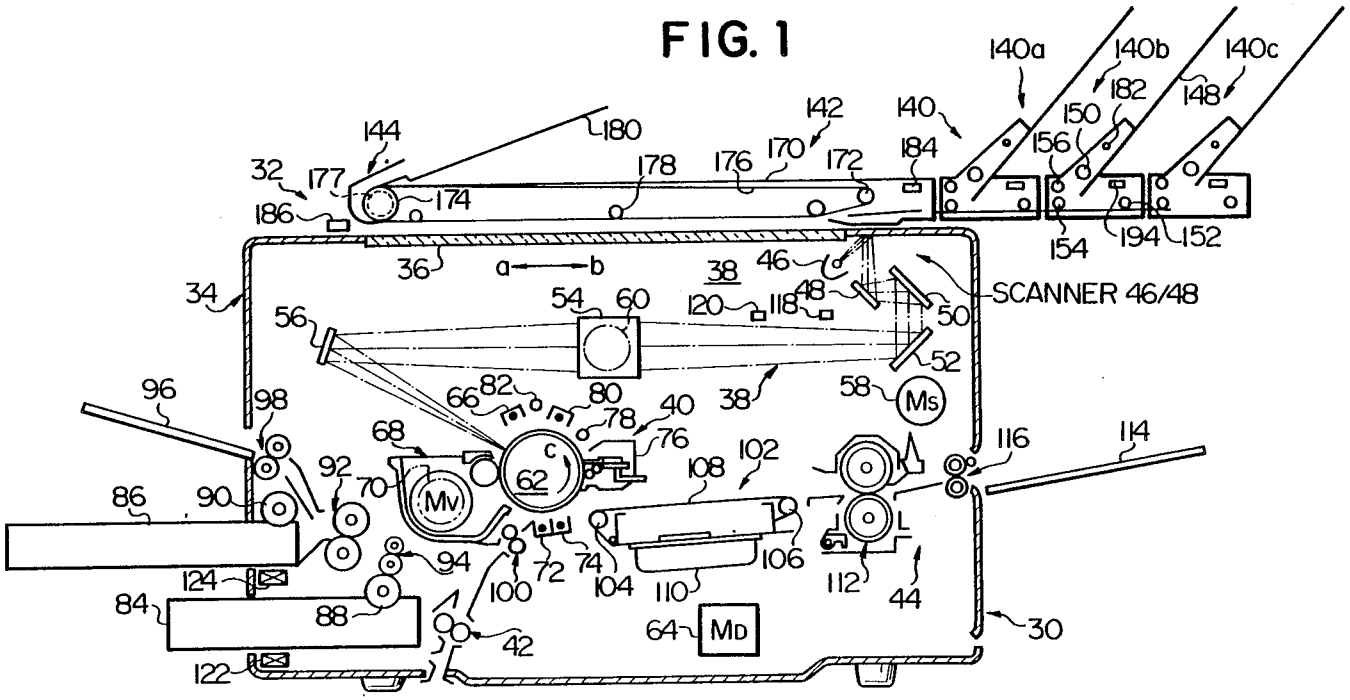
FIG. 1 elevation view showing the general mechanical construction and arrangement of a preferred embodiment of an image duplicating apparatus according to the present invention.

As shown in FIG. 1, the image duplicating apparatus embodying the present invention largely consists of a main module implemented by an electrophotographic duplicator module 30, and an optional or subsidiary module implemented by an automatic document feeding module 32 positioned atop the duplicator module 30.

The duplicator module 30 has a housing structure 34 including an upper panel portion which is in part provided by a transparent document support table 36. A sheet of original document bearing images to be reproduced is to be placed on this document support table 36, though not shown in the drawings. The duplicator module 30 further comprises an optical document scanning system 38, an image reproducing system 40, a paper feed mechanism 42 and an image fixing assembly 44.

The optical document scanning system 38 comprises a light exposure lamp 46 from which a beam of light is emitted toward the lower face of the original document on the document support table 12. The beam of light incident on and reflected from the original document is downwardly directed to an object mirror 48 and is re-directed rightwardly in the housing structure 34. The lamp 46 and object mirror 48 are movable together along the document support table 12 and implement, in combination, a document scanner 46/48 of the duplicator module 30 under consideration. The document scanner 46/48 has a predetermined home position with respect to the document support table and is movable leftwardly from and rightwardly back to the home position as indicated by arrows a and b in the drawing. The home position of the document scanner 46/48 is herein assumed to be close to the rightmost end of the document support table 12 as shown.

The light reflected from the object mirror 48 is redirected toward a second mirror 50, which further redirects the light downwardly toward a third mirror 52. The mirrors 50 and 52 are also movable along the document support table 12 into and out of predetermined home positions with respect to the document support table. From the mirror 52, the light travels leftwardly along the document support table 12 and is passed through an image magnification/reduction lens unit 54 (hereinafter referred to simply as magnification lens unit) to a projection mirror 56. The magnification lens unit 54 is movable along the document support table 12 independently of the document scanner 46/48 and the combination of the mirrors 50 and 52 with respect to the table 12. Movement of the magnification lens unit 54 in either direction with respect to the projection mirror 32 results in a change in the magnification/reduction (M/R) ratio (hereinafter referred to simply as magnification ratio) of the images to be reproduced.

The document scanner 46/48 composed of the combination of the exposure lamp 46 and mirror 48 is operatively coupled to suitable drive means and is to be driven to travel at a speed doubling the speed of movement of the combination of the mirrors 50 and 52. Such drive means is also operative to drive the combination of the mirrors 50 and 52 and is herein assumed to include a d.c. scanner drive motor 34 ($M_S$) and a suitable reduction gear mechanism (not shown). The magnification lens unit 54 is also operatively coupled to suitable drive means, which is assumed to include a pulse-driven stepper motor 36 and will be referred to as lens drive motor ($M_L$).

The image reproducing system 40 comprises a cylindrical image transfer drum 62 having a conductive peripheral surface layer coated with a photoconductive substance. The light directed to the image reproducing system 40 is re-directed toward this image transfer drum 62 and is focused onto the peripheral surface of the drum 62. The image transfer drum 62 is driven for rotation in a direction indicated by arrow c by appropriate drive means, which is assumed to include a main drive motor 64 ($M_D$). The document scanner 46/48 and the combination of the mirrors 50 and 52 are driven for movement at speeds proportional to the peripheral speed (V) of rotation of the image transfer drum 62. A change in the position of the magnification lens unit 54 with respect to the image transfer drum 62 results in a change in the magnification ratio (N) of the images to be reproduced. In the embodiment herein shown, it is assumed by way of example that the document scanner 46/48 composed of the lamp 46 and mirror 48 are driven for movement at a speed V/N and the combination of the mirrors 50 and 52 driven at a speed V/2N.

The image reproducing system 40 further comprises a main charger 66 to sensitize the photoconductive peripheral surface of the image transfer drum 62 by applying electrostatic charges uniformly to the surface of the drum 62. These charges are dissipated in areas exposed to light and electrostatic latent images are created by the charges remaining on the drum 62 upon irradiation with light from the mirror 32. Posterior to the path of light to the drum 62 is located an image developing unit 68 having a stock of toner particles to be applied to the photoconductive peripheral surface of the image transfer drum 62. Visible toner images are thus produced conformingly to the latent images produced on the peripheral surface of the drum 62. The image developing unit 68 has a developer drive motor 70 ($M_V$) incorporated therein.

Posterior to the image developing unit 68 in turn is provided an image transfer charger 72 which is operative to charge a print sheet so that the toner images on the image transfer drum 62 are transferred to the print sheet. The print sheet thus having the toner images received thereon is cleared of remaining charges by a separation charger 74 located posterior to the image transfer charger 72. There is further provided a drum cleaner unit 76 which removes residual toner particles from the peripheral surface of the drum 62. Posterior to this cleaner unit 76 in turn is positioned a main charge eraser lamp 78 which irradiates the cleaned peripheral surface of the drum 62 to eliminate the charges which may be left thereon. Indicated at 80 and 82 are an auxiliary charger and an auxiliary charge eraser lamp, respectively. Though not shown, each of the chargers 66, 72, 74 and 80, developing and cleaner units 68 and 76 and eraser lamps 78 and 82 includes or is associated with appropriate driver or actuator means.

The print-sheet feed mechanism 42 is provided in conjunction with lower and upper print-sheet supply cassettes 84 and 86 which are detachably fitted to the housing structure 34 and which have stocks of print sheets of different sizes stored therein. The print-sheet feed mechanism 42 per se comprises lower and upper print-sheet feed rollers 88 and 90 each of which is driven for rotation to pick up print sheets one after another from the stack of paper in the cassette 84 or 86. The print sheet picked up by the lower print-sheet feed roller 88 is guided to travel directly toward the image transfer drum 62. The print-sheet feed roller 88 is held in rollable contact with one of a pair of guide rollers 92 which are held in rollable contact with each other. In association with the upper print-sheet supply cassette 86 is provided a pair of guide rollers 94 which are held in rollable contact with each other and which are located between the upper print-sheet feed roller 90 and the pair of guide rollers 92. A print sheet picked up by the upper print-sheet feed roller 90 is first passed between the guide rollers 94 and subsequently between the guide rollers 92 and is thereafter directed toward the image transfer drum 62.

In addition to the lower and upper print sheet supply cassettes 84 and 86 is provided a manual print sheet supply table 96 allowing manual insertion of a print sheet into the duplicator module 30 through a slot formed in the left panel portion of the housing structure 34. In association with this manual print sheet supply table 96 is provided a pair of print sheet guide rollers 98 through which the print sheet manually inserted into the duplicator module 30 is fed to the guide roller pair 92 and further to the guide roller pair 94.

Posterior to the developing unit 68 is provided a pair of timing rollers 100 which are held in rollable contact with each other. A print sheet passed from the lower print-sheet feed roller 88 or through the guide rollers 92 is passed to the timing rollers 100. The timing rollers 100 are to be driven for rotation at a timing synchronized with the movement of the document scanner 46/48. Each of the print-sheet feed rollers 88 and 90 and one of the timing rollers 100 is operatively connected to the main drive motor 64 through an actuator typically implemented by a solenoid-operated clutch (not shown).

The print-sheet feed mechanism 42 further comprises a print-sheet transport belt assembly 102 positioned posterior to the area where a print sheet is to be separated from the image transfer drum 62. The transport belt assembly 102 comprises spaced driven and idler rollers 104 and 106 and an endless transport belt 108 passed between the rollers 104 and 106. The transport belt 108 may be formed with perforations provided in conjunction with any suction generator unit 110. The suction induced by the suction generator unit 110 acts, through the perforations in the belt 108, on the print sheet being transported on the belt 108 and retains the print sheet to the belt 108 until the print sheet is released from the belt 108.

The image fixing assembly 44 is provided at the rear of the transport belt assembly 102 and comprises a pair of heater rollers 112 arranged to form therebetween a nip aligned with the path of travel of a print sheet from the belt assembly 102. The print sheet transported on the transport belt 108 is thus nipped between the heater rollers 112 so that the toner particles carried on the sheet are thermally fused and the toner images are fixed on the print sheet. The print sheet released from the rollers 112 is withdrawn to a paper collect tray 114 through a pair of paper discharge rollers 116 located posterior to the heater rollers 112 and a paper discharge slot provided in the rear panel portion of the housing structure 34.

Each of the indicators included in the main control panel 200 and the individual segments forming the numerical display window 206 is implemented typically by a light emitting diode.

In the duplicator module 30 are provided various sensors and detectors which include a home position sensor 118 and a scan timing sensor 120 located in association with, for example, the exposure lamp 46. The home position sensor 118 produces a home position signal $S_{HP}$ of a logic "1" state in the presence of the document scanner 46/48 in the home position thereof while the scan timing sensor 120 produces a scan timing signal $S_{ST}$ of a logic "1" state at a timing the document scanner 46/48 driven for movement with respect to the document support table 36 reaches a predetermined position ahead of its home position.

In association with the lower and upper print sheet supply cassettes 84 and 86 are provided cassette sensors 122 and 124 each responsive to the magnetic elements (not shown) attached to each of the cassettes 84 and 86. The magnetic elements on each of the print sheet supply cassettes 84 and 86 are patterned so that the cassette sensor associated with each cassette is operative to produce a four-bit binary coded print sheet size signal which is prescribed for the particular cassette and which is thus indicative of the size of the print sheets stored in the cassette. Thus, the cassette sensor 122 associated with the lower print sheet supply cassette 84 is operative to produce a four-bit binary coded print sheet size signal $D_{PS1}$ indicative of the size of the print sheets stored in the cassette 84. Likewise, the cassette sensor 124 associated with the upper print sheet supply cassette 86 is operative to produce a four-bit binary coded print sheet size signal $B_{PS2}$ indicative of the size of the print sheets stored in the cassette 86.

On the other hand, the automatic document feed module 32 implementing the subsidiary module of the image duplicating apparatus embodying the present invention largely comprises a document supply assembly 140 to place an original document on the document support table 40, a document transport assembly 142 to convey the original document to a predetermined position on the document support table 40, and a document discharge assembly 144. These assemblies 140, 142 and 144 are arranged in series in a horizontal direction in which an original document is to be conveyed through the automatic document feed module 32.

The document supply assembly 140 consists of a plurality of document supply units which are shown including first, second and third document supply units **140*a*, 140*b* and 140*c* arranged in line with the document transport assembly 142. These document supply units 140*a*, 140*b* and 140*c* are constructed similarly, each comprising, as numbered in regard to the second document supply unit 140*b*, a casing 146 having document inlet and outlet ports and a document supply tray 148 extending into the casing 146 through the document inlet port. On the document supply tray 148 may be placed a single original document or a plurality of original documents (not shown). Thus, each of the document supply units 140*a*, 140*b* and 140*c* further comprises a document supply roller 150 to pick up the original document or the plurality of original documents one after another from the tray 148, and document feed rollers 152 and 154 located at the trailing and leading ends, respectively, of the casing 146. The document feed rollers 152 and 154 are driven for rotation by means of a roller drive motor 156 ($M_F$) positioned within the casing 146**.

Thus, in the first document supply unit 140*a*, the original document picked up from the tray 148 by the document supply roller 150 or received from the second document supply unit 140*b* through the document feed rollers 152 and 154 of the first document supply unit 140*a* is passed into the document transport assembly 142 by means of the document feed roller 154 of the first document supply unit 140*a*. In the second document supply unit 140*b*, the original document picked up from the tray 148 by the document supply roller 150 or received from the third document supply unit 140*c* through the document feed roller 152 of the second document supply unit 140*b* is passed into the first document supply unit 140*a* by means of the document feed roller 154 of the second document supply unit 140*b*. In the third document supply unit 140*c*, the original document picked up from the tray 148 by the document supply roller 150 is passed into the second document supply unit 140*b* by means of the document feed roller 154 of the third document supply unit 140*c*.

Figure 2:
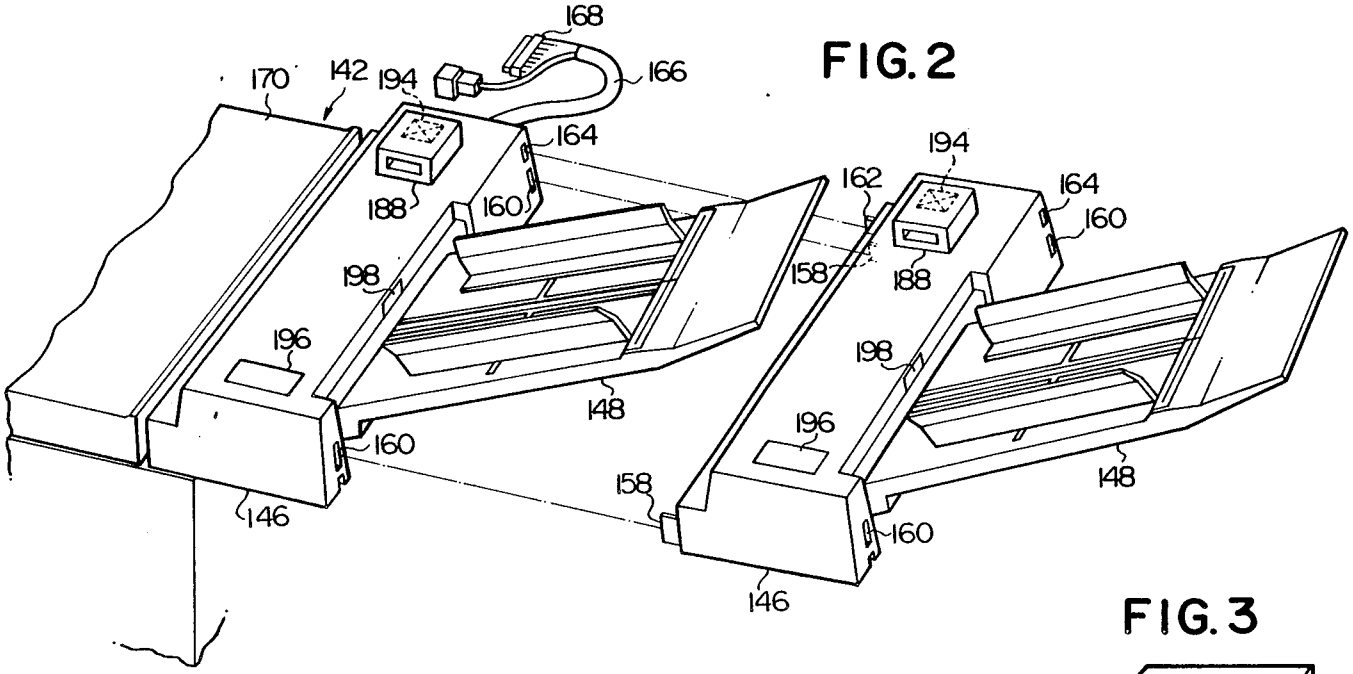
FIG. 2 is fragmentary perspective view showing, to an enlarged scale, part of the document supply assembly included in the automatic document feed module of the image duplicating apparatus illustrated in FIG. 1.

As illustrated to an enlarged scale in FIG. 2 in which only two, viz., the first and second document supply units, of the three document supply units 140*a*, 140*b* and 140*c* are shown, the first, second and third document supply units 140*a*, 140*b* and 140*c* are detachably coupled in series to form the document supply assembly 140. For this purpose, each of the document supply units 140*a*, 140*b* and 140*c* is provided with a pair of lug portions 158 projecting from the casing 146 of each of the document supply units as will be seen on the second document supply unit 140*b* and a pair of ports 160 are formed and open in the rear end wall of the casing 146 of each document supply unit and aligned with the lug portions 158 of the other document supply units. Though not shown in the drawings, ports similar to the ports 160 provided in each of the document supply units 140*a*, 140*b* and 140*c* are also formed in the document transport assembly 142 and aligned with the lug portions 158 of the first document supply unit 140*a*. Thus, the lug portions 158 of the second or third document supply unit 140*b* or 140*c* are detachably received in the ports 160 in the first or second document supply unit 140*a* or 140*b*, respectively, and the lug portions 158 of the first document supply unit 140*a* are detachably received in the ports in the document transport assembly 142.

The three document supply units 140*a*, 140*b* and 140*c* are further coupled together electrically by suitable connector arrangements. Such connector arrangements are herein shown including a connector plug 162 projecting forwardly from the casing 146 of each document supply unit and a socket 164 formed in the rear end wall of the casing 146 of each document supply unit and aligned with the connector plugs 162 of the other document supply units. Though not shown, a socket is also provided in the document transport assembly 142 and aligned with the connector plugs 162 of the first document supply unit 140*a*. Thus, the connector plug 162 of the second or third document supply unit 140*b* or 140*c* is disconnectably received in the socket 164 in the first or second document supply unit 140*a* or 140*b*, respectively, and the connector plug 162 of the first document supply unit 140*a* is disconnectably received in the socket in the document transport assembly 142.

In substitution for the electrical connection provided by the plug and socket arrangement between the first document supply unit 140*a* and the document transport assembly 142 may be used a wire cable 166 terminating in a connector plug 168. The connector plug 168 may be fitted to the document transport assembly 142 through a socket provided in the transport assembly 142 or alternatively to the duplicator module 30 through a socket provided in the module 30, though not shown in the drawings.

The document transport assembly 142 comprises a lid panel 170 and is arranged to be rockable in its entirety away from and toward the document support table 40 about an axis extending lengthwise of the transport assembly 142. The lid panel 170 has carried thereon a conveyor mechanism including belt drive rollers 172 and 174 spaced apart in parallel from each other and positioned in the vicinity of the trailing and leading ends, respectively, of the document transport assembly 142. An endless transport belt 176 is passed between these rollers 172 and 174 and has a lower travelling path portion which extends in parallel with the document support table 40 and which is to travel in the direction of advancement of original document. Between the belt drive rollers 80 and 82 are arranged guide and pressing rollers 178 which are held in rollable contact with the inner surface of the lower travelling path portion of the belt 176 to press the particular portion of the belt 176 into slidable contact with the upper face of the document support table 40. One of the belt drive rollers such as the roller 174 located at the leading end of the document transport assembly 142 is driven for rotation by means of a belt drive motor 177 ($M_B$). An original document supplied from the document supply assembly 140 to the document transport assembly 142 is moved by the transport belt 176 to a correct "exposure position" on the document support table 40 and is scanned by the optical scanning system 44 of the duplicator module 30. After the original document set on the document support table 40 is thus scanned by the optical scanning system 44, the original document is either withdrawn to a document recovery tray 180 forming part of the lid panel 170 and a subsequent original document on the document supply tray 148 is transferred to the document support table 40. This operation is repeatedly performed until all the original documents stored on the document supply tray 148 have been duplicated. The driven roller 172 is operatively connected to the belt drive motor 80 through suitable actuator means such as a solenoid-operated clutch.

The lid panel 170 forming part of the document transport assembly 142 is hingedly assembled to the housing structure 38. The document transport assembly 142 as a whole is thus rockable between a "closed" angular position having the lower travelling path portion of the belt 176 held in slidable contact with the document support table 40 as shown in FIG. 1 and an "open" angular position angularly spaced apart upwardly from the document support table 40. The lid panel 170 of the document transport assembly 142 being thus opened up from the document support table 40 of the duplicator module 30, the operator is allowed for direct access to the document support table 40 to manually place an original document on the upper face of the document support table 40.

The duplicator module 30 of the apparatus embodying the present invention further comprises various sensors and detectors arranged within the main and subsidiary modules 10 and 12. The sensors and detectors provided in association with the automatic document feed module 32 include a document-on-tray sensor 182 located in conjunction with the document supply tray 148 of each of the document supply units 140*a*, 140*b* and 140*c*. The document-on-tray sensor 182 is responsive to the presence or absence of at least one original document on the document supply tray 148 of each document supply unit and is operative to produce an output signal $S_{D1}$ of a logic "1" state in the presence of an original document on the tray 148. On the other hand, the document transport assembly 142 has provided therein a document-on-table sensor 184. The document-on-table sensor 184 is located adjacent the document inlet port of the document transport assembly 142 and is responsive to the presence or absence of at least one original document on the document support table 40 of the duplicator module 30 and is operative to produce output signal $S_{D2}$ of logic "1" state in the presence of an original document on the document support table 40. In the vicinity of the document discharge assembly 144 is provided a document discharge sensor 186 which is responsive to the presence of an original document passing through the document discharge assembly 144. The document discharge sensor 186 is operative to produce an output signal $S_{D3}$ of a logic "1" state in response to an original document passing through the document discharge assembly 144.

Figure 3:
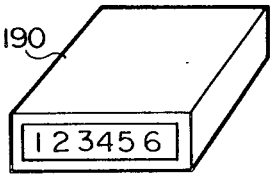
FIG. 3 is a perspective view of a key/counter console for use in the automatic document feed module included in the duplicating apparatus embodying the present invention.

The image duplicating apparatus embodying the present invention is of the type having a machine management system implementing machine locking and output counting means adapted to maintain the apparatus in a locked condition unless a "key/counter" as herein so referred to is loaded into the system. Turning back to FIG. 2, each of the document supply units 140*a*, 140*b* and 140*c* of the automatic document feed module 32 thus further comprises a key/counter socket compartment 188 mounted on the casing 146 and forming part of the machine management system. The socket compartment 188 thus provided in each of the document supply units 140*a*, 140*b* and 140*c* is adapted to receive therein a key/counter 190 (FIG. 3) implementing the unlocking and output count register means for the management system.

When the key/counter 190 is loaded into the socket compartment 188 in any of the document supply units 140*a*, 140*b* and 140*c*, the machine management system unlocks the duplicating apparatus and is operative to count the quantity of the printed outputs produced after the key/counter 190 is loaded into the socket compartment 188. Within the socket compartment 188 of each document supply unit is located a key/counter detector 194 which is adapted produce an output signal $S_{KC}$ of a logic "1" state in the presence of the key/counter 190 inserted into the socket compartment 188.

In the key/counter 190 are given ahthorizations for users authorized to use the apparatus so that the authorized users alone are permitted to unlock and use the apparatus. Each time a printing step is terminated and accordingly a printed output produced from the apparatus, the count of the printed outputs produced is incremented in the management system to update the count of printed outputs registered in the key/counter 190 currently loaded into the socket compartment 188. When a cycle of copying operation which may consist of a single printing step or a succession of printing steps is complete, the number of the printing steps repeated and counted by the management system after the key/counter 190 was loaded into the system is thus registered in the key/counter 190 and is displayed thereon. The number of the printing steps repeated during the cycle of copying operation just terminated is added to the number of the printing steps which had been registered in the key/counter 190 until the key/counter 190 was loaded into the socket compartment 188. The count of the printed outputs registered in the key/counter 190 being thus updated, the user of the key/counter 190 is enabled to know the total quantity of the printed outputs which have been produced since the count registered in the key/counter was last reset. Thus, the management system has a count increment signal generator associated with each of the document supply units 140*a*, 140*b* and 140*c*, though not shown in the drawings.

Each of the document supply units 140*a*, 140*b* and 140*c* of the automatic document feed module 32 further comprises a control panel 196 through which to enter a desired number $N_{OUT}$ of printed outputs to be produced for the original document or for each of the original documents placed on the document supply tray 148 of the document supply unit. Furthermore, a magnetic user identification sheet sensor 198 is located in conjunction with the document inlet port of the casing 146 of each of the document supply units 140*a*, 140*b* and 140*c*. This user identification sheet sensor 198 is provided to detect the presence or absence of a magnetic user identification sheet (not shown) placed on an original document or a stack of original documents on the document supply tray 148 of the document supply unit 140*a*, 140*b* or 140*c*. In the presence of a user identification sheet placed on an original document or a stack of original documents on the document supply tray 148 of any of the document supply units 140*a*, 140*b* and 140*c*, the user identification sheet sensor 198 in the particular document supply unit produces an output signal $S_{UI}$ of a logic "1" state.

When a user desires to use two or more document supply units, the user load the key-counter into the key/counter socket compartment of the document supply unit and places the magnetic user identification sheet on the original document or the stack of the original documents placed on the document supply tray 148 of the other document supply unit. When it is detected by the user identification sheet detector 194 of a document supply unit that there is a user identification sheet placed on the original document or the stack of original documents on the document supply tray 148 of the document supply unit, the quantity of the printed outputs counted in respect of the document supply unit is registered into the key/counter 190 loaded into the other document supply unit.

Each of the indicators 232, 234 and 238*a* to 238*d* included in the auxiliary control panel 196 and the individual segments forming the numerical display window 228 is also implemented typically by a light emitting diode.

General Configuration of Main Control Panel

Figure 4:
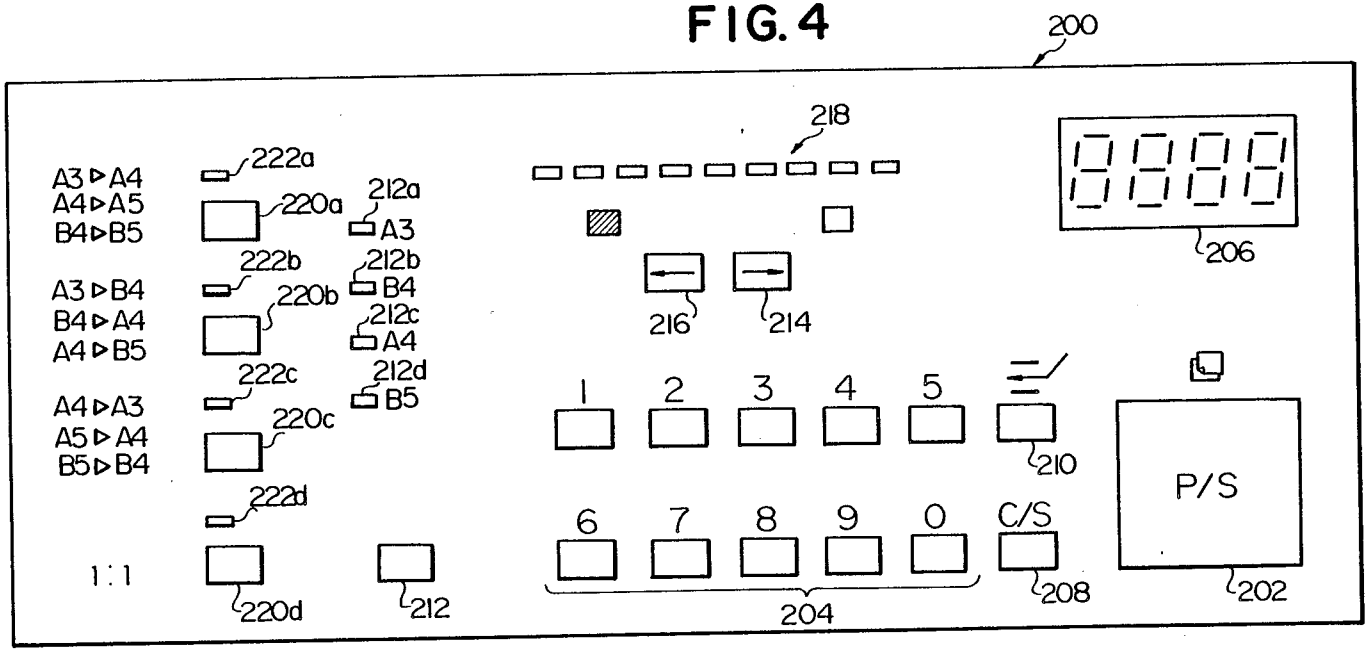
FIG. 4 is a plan view schematically showing the general key and indicator configuration of the control panel forming part of the duplicator module of the image duplicating apparatus illustrated in FIG. 1.

The various functions achievable by the image duplicating apparatus embodying the present invention will be understood from the following description regarding the general configuration of a main control panel 200 forming part of the duplicating apparatus. FIG. 4 shows the general key and indicator configuration of the main control panel 200.

Referring to FIG. 4, the main control panel 200 comprises a print start key 202 (P/S) to start a cycle or cycles of duplicating operation and a set of numerical keys 204 allocated to numerals 1, 2, ... and 0, respectively. With the print start key 202 depressed, there is a print-start signal $S_{PS}$ of a logic "1" state produced in the control panel 200 to indicate that the system is required to operate for copying operation for a given original document. The numerical keys 204 are typically used to enter a desired number of printed outputs. The desired number of printed output thus entered from the numerical keys 204 is displayed on a seven-segment four-digit numerical display window 206 and can be cleared from a clear/stop key 208 (C/S) which may be used also for cancelling the instruction once entered from the print start key 202. During printing of a preset quantity of print sheets for a given original document, another original document may be duplicated in an interrupt mode entered at an interrupt request key 210.

The size of print sheets to be used can be selected at a manual print sheet size select key 212 from among a predetermined number of document sizes available. The selected size of print sheet is displayed by any of print sheet size indicators 212*a*, 212*b*, 212*c* and 212*d* which are herein assumed to be assigned to the standardized A3, B4, A4 and B5 sizes, respectively, as shown. Further provided are print density increment and decrement keys 214 and 216 to permit manual selection of a desired density for printing. The print density is stepwise incremented with the key 214 depressed or decremented with the key 216 depressed. A series of print density display indicators 218 are activated to illuminate successively in one direction with the increment key 214 kept depressed and in the other direction with the decrement key 216 kept depressed.

On the main control panel 200 are further provided a set of magnification ratio select keys 220*a*, 220*b*, 220*c* and 220*d* having respectively associated indicators 222*a*, 222*b*, 222*c* and 222*d*. The keys 220*a* to 220*d* are assumed to be used for the selection of any of first and second ratios for reduced copying, a ratio for magnified copying and a ratio for equal-size copying. With one of the keys 220*a* to 220*d* depressed, the associated one of the indicators 222*a* to 222*d* is activated to illuminate to indicate the selected ratio for copying.

Configuration of Auxiliary Control Panel

Figure 5:
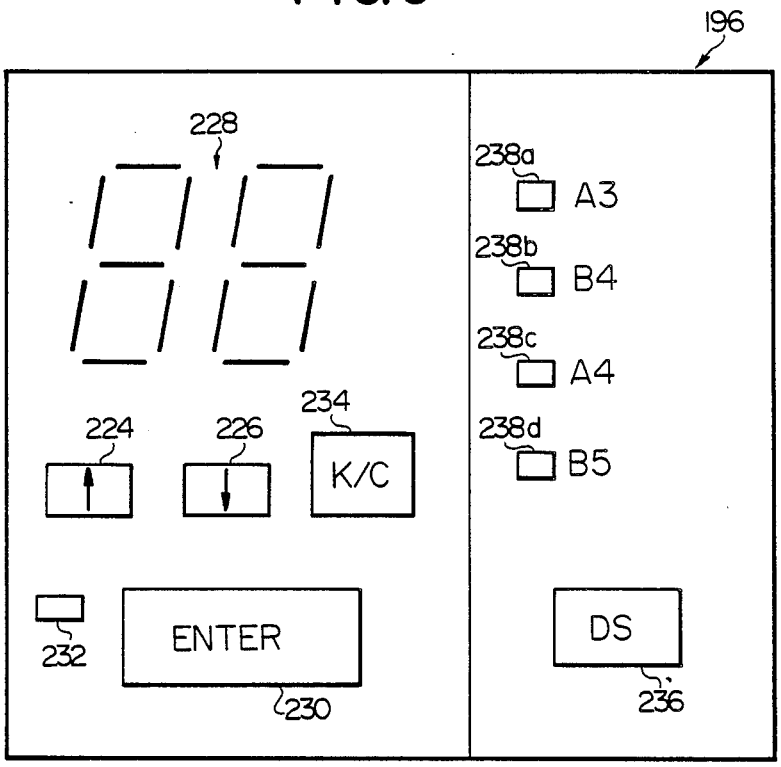
FIG. 5 is a plan view schematically showing the key and indicator configuration of the control panel forming part of each of the document supply units of the automatic document feed module of the image duplicating apparatus illustrated in FIG. 1.

FIG. 5 shows an example of the key and indicator configuration of the auxiliary control panel 196 provided in each of the document supply units 140*a*, 140*b* and 140*c* of the automatic document feed module 32.

On the auxiliary control panel 196 of each document supply unit are provided print quantity increment and decrement keys 224 and 226 to select a desired quantity $N_{OUT}$ of printed outputs to be produced. The desired quantity $N_{OUT}$ of printed outputs is stepwise incremented with the key 224 depressed or decremented with the key 226 depressed. The quantity of printed outputs $N_{OUT}$ thus selected from the increment or decrement key 224 or 226 is displayed on a seven-segment two-digit numerical display window 228 and is entered when a print quantity enter key 230 is depressed. The print quantity enter key 230 has an associated indicator 32 which is turned on to illuminate when the key 230 is thus depressed to enter the quantity of printed outputs $N_{OUT}$ indicated on the display window 228. Also provided on the auxiliary control panel 196 is a key/counter load indicator 234 (KC) which is to be turned on to illuminate when the key/counter 190 (FIG. 3) is loaded into the socket compartment 188 of any of the document supply units 140*a*, 140*b* and 140*c* of the automatic document feed module 32.

The size of the original documents to be used can be entered through a manual document size select key 236 from among a predetermined number of document sizes available.

The selected size of original document is displayed by any of document size indicators 238*a*, 238*b*, 238*c* and 238*d* which are herein assumed to be assigned to the standardized A3, B4, A4 and B5 sizes, respectively, as shown.

Assume now that the print start key 202 is depressed with the lid panel 170 closed to the document support table 40 of the duplicator module 30 and a set of original documents placed on the document supply tray 148 of any of the first, second and third document supply units 140*a*, 140*b* and 140*c*. The duplicator module 30 is now ready for operation and, in the automatic document feed module 32, the roller drive motor 156 ($M_F$) in any of the document supply units 140*a*, 140*b* and 140*c* and the belt drive motor 177 ($M_B$) in the document transport assembly 142 are actuated to drive the associated document feed rollers 152 and 154 and the belt drive rollers 172 and 174, respectively. The document feed rollers 152 and 154 of one of the document supply units 140*a*, 140*b* and 140*c* being driven for rotation, one of the original documents placed on the document supply tray 148 of the particular document supply unit is passed into the document transport assembly 142. In this instance, the original document may be passed to the document transport assembly 142 directly from the first document supply unit 140*a*, by way of the first document supply unit 140*a* from the second document supply unit 140*b*, or through the second and first document supply units 140*b* and 140*a* from the third document supply unit 140*c*. The original document thus supplied from the document supply assembly 140 to the document transport assembly 142 is moved on the document support table 40 by means of the transport belt 176 and is brought to a stop upon lapse of a predetermined period of time after the leading end of the original document is detected by the document-on-table sensor 184. At the point of time the leading end of the original document is detected by the sensor 184, an instruction signal is supplied from the automatic document feed module 32 to the duplicator module 30 to initiate the duplicator module 30 into operation for producing a desired number of printed outputs for each of the original documents successively supplied from one of the document supply units 140*a*, 140*b* and 140*c*. When the cycle of copying operation is complete with the printing steps repeated the desired number of times for the original document supplied, an instruction signal is supplied from the duplicator module 30 to the automatic document feed module 32 to enable the automatic document feed module 32 to withdraw the original document to the document recovery tray 180. If it is then detected by the document-on-tray sensor 182 that there is another original document placed on the document supply tray 148 of the document supply unit in question, the new original document is transferred to the document support table 40 while the original document which has already been duplicated is being withdrawn to the document discharge tray 180 of the automatic document feed module 32.

General Arrangement of Control Circuit

Figure 6A:
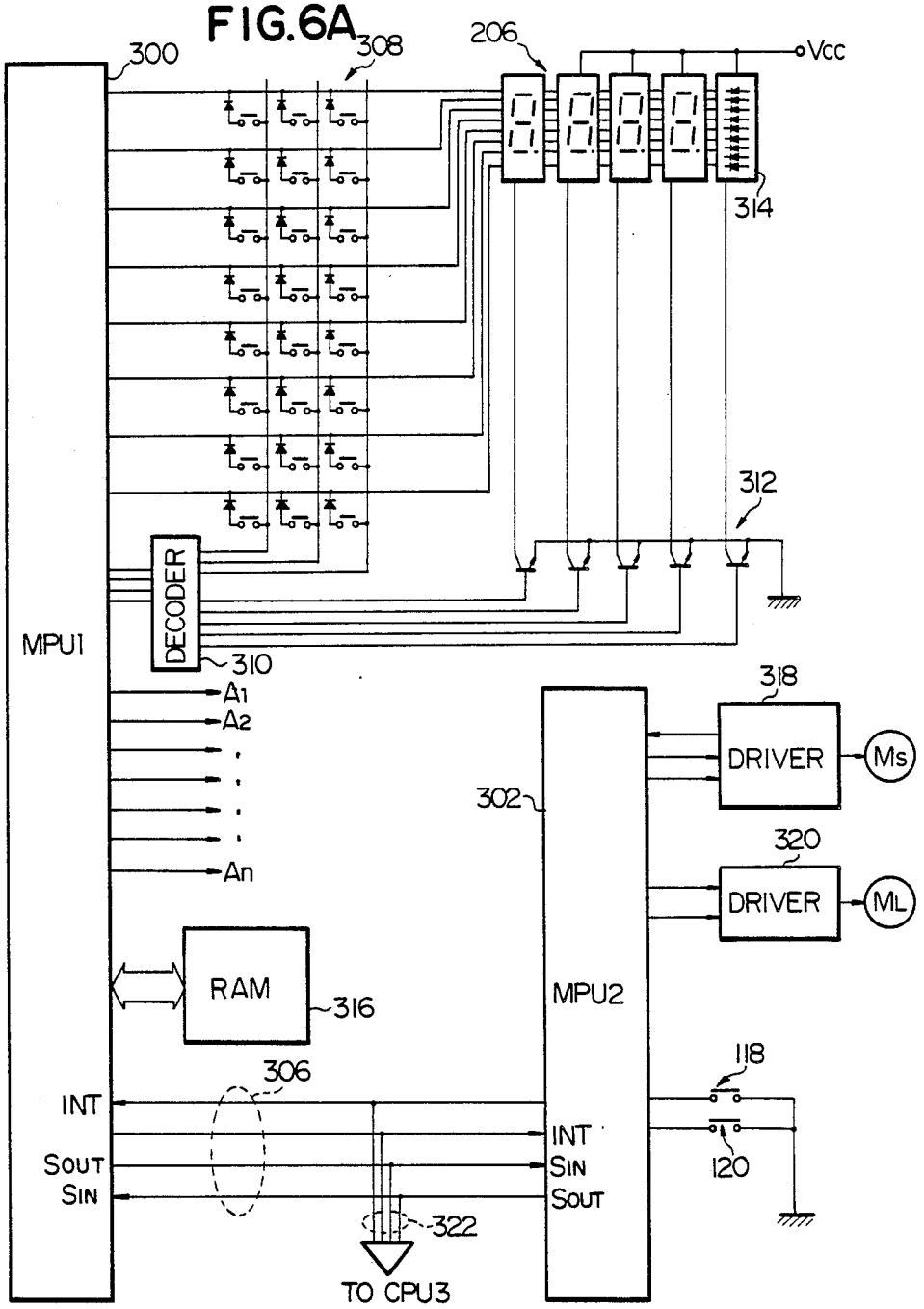
FIGS. 6A and 6B are complementary diagrams schematically showing the general arrangement of a control circuit which may be incorporated in the image duplicating apparatus embodying the present invention.
Figure 6B:
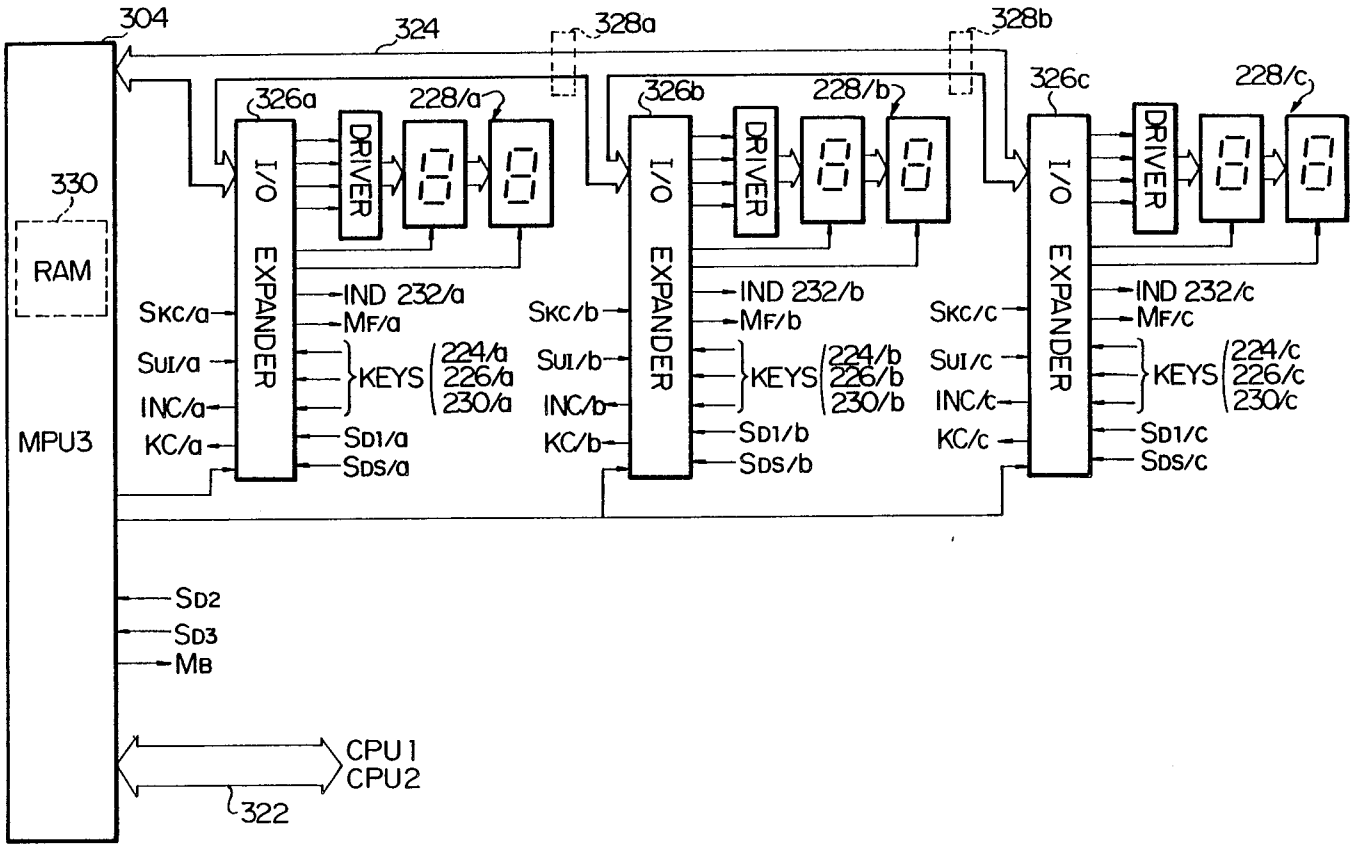

FIGS. 6A and 6B show the general arrangement of a control circuit which may be used to achieve the functions hereinbefore described with reference to FIGS. 1 to 5. The control circuit comprises first, second and third microprocessor units 300, 302 and 304 (respectively labeled MPUl, MPU2 and MPU3) which have interrupt (INT) and data input and output ($S_{IN}$, $S_{OUT}$) ports connected together through bus lines 306. The first microprocessor unit 300 is operative to control the operation of the image reproducing system 40, print sheet feed system 42, and image fixing system 44 of the duplicator module 30 while the second microprocessor unit 302 is predominant over the operation of the optical scanning system 38 of the duplicator module 30. The third microprocessor unit 304 is operative to control the operation of particularly the automatic document feed module 32.

As shown in FIG. 6A, the first microprocessor unit 300 has input ports connected to a matrix circuit 308 composed of normally-open switch elements including those associated with the various keys provided on the main control panel 200 and the segment electrodes of the display window 206 on the control panel 200. The microprocessor unit 300 further has output ports including those connected through an address decoder 310 to the matrix circuit 308 and to switch elements 312 for the display window 206 and light emitting diodes (LEDs) implementing the various indicators (herein indicated collectively at 314) provided on the main control panel 200.

The first microprocessor unit 300 further has output ports Al, A2, ... An connected to driver and actuator circuits for the various electrically driven units of the image reproducing system 40, print-sheet feed system 42, and image fixing system 44 of the duplicator module 30. These units include the main drive motor 64 ($M_D$) for driving the image transfer drum 62 and the various rollers included in the print sheet feed system 42, the developer drive motor 70 ($M_V$ provided in the developing assembly 68, clutches for the print-sheet feed and guide rollers 88, 90, 92, 94 and 98, the timing rollers 100, and the chargers 66, 72, 74 and 80 and charge eraser lamps 78 and 82 provided in association with the image transfer drum 62. The first microprocessor unit 300 is further connected to a random-access memory (RAM) 316 (hereinafter referred to simply as memory 316) for storing data supplied from the switch elements included in the matrix circuit 308 and data supplied from the second and third microprocessor units 302 and 304.

The second microprocessor unit 302 has input ports connected to the home position and scan timing sensors 118 and 120 provided in association with the optical scanning system 38 of the duplicator module 30. The second microprocessor unit 302 is thus operative to control various driver circuits included in the scanning system 38 in response to the home position and scan timing signals $S_{HP}$ and $S_{ST}$ from the sensors 118 and 120, respectively. Such driver circuits include a driver circuit 318 connected to the scanner drive motor 58 ($M_S$) for driving the document scanner 46/48 and a driver circuit 320 connected to the lens drive motor 60 ($M_L$) for driving the magnification lens unit 54 which forms part of the scanning system 38.

As shown in FIG. 6B, the third microprocessor unit 304 predominant over the operation of the automatic document feed module 32 has interrupt and data input and output ports connected through bus lines 322 to the first and second microprocessor units 300 and 302. The third microprocessor unit 304 further has input ports including those responsive to the signal $S_{D2}$ from the document-on-table sensor 184 in the document transport assembly 142, and the signal $S_{D3}$ from the document discharge sensor 186 in the document discharge assembly 144 of the automatic document feed module 32, and output ports including a port connected to a driver circuit for the belt drive motor 177 ($M_B$) provided in the document transport assembly 142 of the automatic document feed module 32.

The third microprocessor unit 304 further has input/output ports connected through an extensible bidirectional data bus 324 to a parallel combination of input/output expander circuits **326*a*, 326*b* and 326*c* which are associated with the first, second and third document supply units 140*a*, 140*b* and 140*c*, respectively, of the automatic document feed module 32. The data bus 324 is extended to the second and third document supply units 140*b* and 140*c* by means of connectors 328*a* and 328*b*, respectively. Each of the input/output expander circuits 326*a*, 326*b* and 326*c* have input and output ports connected to driver and actuator circuits for the sensors and various operative units and elements provided in each of the document supply units 140*a*, 140*b* and 140*c*, respectively, of the automatic document feed module 32. In the circuit arrangement shown in FIG. 6B, these sensors and operative units and elements of each of the first, second and third document supply units 140*a*, 140*b* and 140*c* are identified by the subscripts "a", "b" and "c" affixed to the numerals indicating those shown in FIGS. 1 and 2, particularly, in connection with the second document supply unit 140*b* shown in FIG. 1**.

Thus, the input ports of each of the input/output expander circuits **326*a*, 326*b* and 326*c* include those connected to a driver circuit for the electrode segments forming the numerical display window 228 in the control panel 196 of each document supply unit, a driver circuit for the indicator 232 associated with the print quantity enter key 230 on the control panel 196, and a driver circuit for the roller drive motor 156 ($M_F$) provided in each document supply unit. The input ports of each of the input/output expander circuits 326*a*, 326*b* and 326*c* further include those connected to a driver circuit for the key/counter load indicator 234 (KC) on the control circuit 188 of each document supply unit and a driver circuit for the previously mentioned count increment signal generator (INC) provided in association with each of the document supply units 140*a*, 140*b* and 140*c***.

Each of the input/output expander circuits **326*a*, 326*b* and 326*c* further has input ports including those connected to the switch elements coupled to the print quantity increment and decrement keys 224 and 226 and print quantity enter key 230 on the control panel 196 of each document supply unit, the document-on-tray sensor 188 in each document supply unit for being responsive to the signal $S_{D1}$ output from the sensor 188, and the document size select key 236 (DS) on the control panel 196 of each document supply unit for being responsive to a signal $S_{DS}$ indicating the size of original document selected through the key 234. The input ports of each of the input/output expander circuits 326*a*, 326*b* and 326*c* further includes those connected to the key/counter detector 194 located within the socket compartment 188 of each document supply unit and responsive to the signal $S_{KC}$ output from the detector 194 and the user identification sheet sensor 198 of each document supply unit and responsive to the signal $S_{UI}$ output from the sensor 196**.

The third microprocessor unit 304 of the control circuit of the apparatus embodying the present invention has incorporated therein a random-access memory 330 (hereinafter referred to simply as memory 330). The memory 330 has memory areas into which are to be stored data representative of some operational conditions and parameters of the first, second and third document supply units 140*a*, 140*b* and 140*c* of the automatic document feed module 32. Table I demonstrates an example of the memory map indicating the data which may thus be stored in these memory areas of the memory 330 at a given point of time during operation of the apparatus. The data stored in the memory areas of the memory 330 include those indicating (1) the presence or absence of an original document in each of the document supply units available, (2) whether or not a cycle of copying operation is in progress with use of each of the document supply units, (3) the order in which the document supply units available are to be put to use in succession when original documents are loaded into two or more of the document supply units available, (4) the quantity of printed outputs designated to be produced for each of the document supply units, and (5) the size of the original documents to be supplied from each of the document supply units.

TABLE I

| Document Supply Units Available | "1" | "2" | "3" | ... | "n" |
|---|---|---|---|---|---|
| Presence/Absence of Document | 1 | 1 | 0 | | — |
| Copying Cycle in Progress | 1 | 0 | 0 | | — |
| Order of Use | 2 | 3 | 1 | | — |
| Quantity of Outputs | 10 | 3 | 5 | | — |
| Document Size | A4 | A3 | A4 | | — |

The document supply units which are herein assumed to be "available" consist of the first, second and third document supply units 140*a*, 140*b* and 140*c* which are identified by the numbers "1", "2" and "3" in the uppermost row of the table. The data relating to these first, second and third document supply units 140*a*, 140*b* and 140*c* identified by the numbers "1", "2" and "3" in Table I are accessed through designation of addresses $D_1$, $D_2$ and $D_3$, respectively, in the memory 330. Generally, the data relating to an ith document supply unit among a total of n number of document supply units provided in the automatic document feed module 32 is identified by the number "i" and is accessed through designation of address $D_i$ in the memory 330.

In the second row of the table, the presence of an original document in each of the document supply units available is represented by a logic value "1" and the absence of an original document in each document supply unit represented by a logic value "0". The logic value "1" in the third row indicates that a cycle of copying operation is currently in progress and the logic value "0" indicates that the document supply unit is currently out of use.

The memory areas for storing data indicated in the second to sixth rows of Table I will be herein referred to as "document presence/absence data ($D_{DOC}$) memory area", "cycle-in-progress data ($D_{CIP}$) memory area", "copying order data ($D_{CO}$) memory area", "print quantity data memory area", and "document size data ($D_{DSZ}$) memory area", respectively.

Main Routine Program for MPU1

Figure 7:
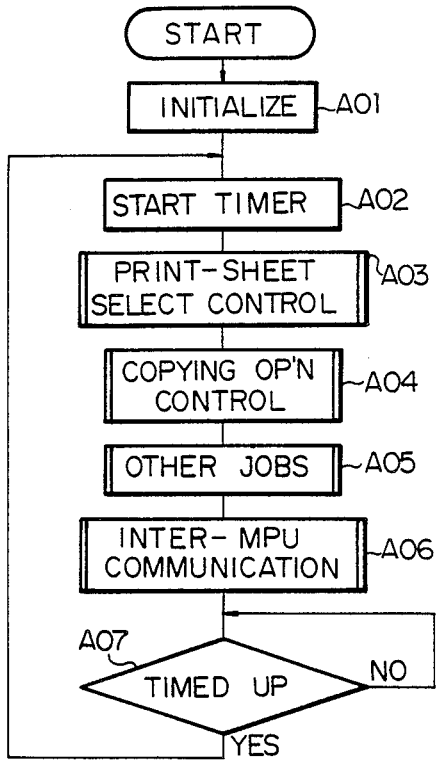
FIG. 7 is a flowchart showing a preferred example of the main routine program to be executed by a master microprocessor unit included in the control circuit illustrated in FIGS. 6A and 6B.

FIG. 7 shows a preferred example of the main routine program to be executed by the first microprocessor unit 300 of the control circuit hereinbefore described with reference to FIGS. 6A and 6B. The main routine program is executed with the apparatus initially switched in and starts with a step A01 to initialize the various registers included in the microprocessor unit 300 and the memory 316 associated with the microprocessor unit 300. The data representative of the various conditions and modes of operation that may have been memorized in the memory 316 and the registers in the microprocessor unit 300 are thus initialized in accordance with prescribed "default" rules. An internal timer of the microprocessor unit 300 is then started at step A02 to count a time interval predetermined for a single complete iteration through the routine program.

The microprocessor unit 300 may then proceeds to print sheet size select control subroutine program A03 by which either the lower print sheet supply cassette 84 or the upper print sheet supply cassette 86 is be selected for use. The details of the print sheet size select control subroutine program A03 will be hereinafter described with reference to FIG. 8.

The print sheet size select control subroutine program A03 may be followed by a copying operation control subroutine program A04 through which copying operation is performed principally under the control of the duplicator module 30 in the modes and conditions selected from the main control panel 200. At a point of time a specified number of printed outputs have been produced through execution of the copying operation control subroutine program A04, the first microprocessor unit 300 transmits to the third microprocessor unit 304 a signal indicating that the current cycle of copying operation is complete. The details of the copying operation control subroutine program A04 will be hereinafter described with reference to FIGS. 10A, 10B and 10C.

The first microprocessor unit 300 may then proceed to a subroutine program A05 to perform various other jobs required for the copying of an original document or original documents. The microprocessor unit 300 may further execute a subroutine program A06 to communicate with the second microprocessor unit 302 for the control of the optical scanning system 38 of the duplicator module 30 and with the third microprocessor unit 304 for the control of the automatic document feed module 32.

When it is thereafter determined at step A07 that the time counted by the internal timer of the microprocessor unit 300 as started at step A02 has lapsed, the microprocessor unit 300 reverts to the step A02 and recycles the subroutine programs A02 to A07.

Description will be hereinafter made with reference to FIG. 8 to FIGS. 22 in regard to the various subroutine programs thus included in the main routine program to be executed by the first control unit 300.

Print-Sheet Select Control Subroutine (A03)

Figure 8:
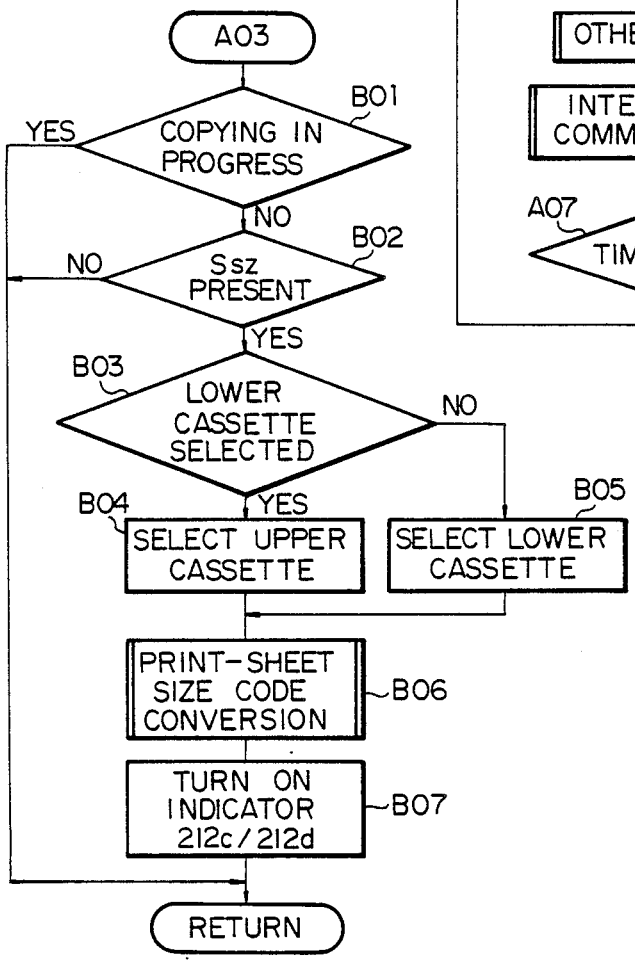
FIG. 8 is a flowchart showing the details of a print sheet size select control subroutine program included in the main routine program illustrated in FIG. 7.

FIG. 8 shows the details of a preferred example of the print sheet size select control subroutine program A03 included in the main routine program described with reference to FIG. 7.

The print sheet size select control subroutine program A03 is executed to select, in effect, either the lower print sheet supply cassette 84 or the upper print sheet supply cassette 86. In the description to follow, it will be assumed by way of example that print sheets of the standard A4 and B5 sizes are stored in the lower and upper print sheet supply cassettes 84 and 86, respectively. Thus, the third indicator 212*c* associated with the print sheet size select key 212 is turned on to illuminate when print sheets of the A4 size in the lower print sheet supply cassette 84 are selected and, when print sheets of the A5 size in the upper print sheet supply cassette 86 are selected, the fourth indicator 212*d* is turned on to illuminate.

The print sheet size select control subroutine program A03 starts with a decision step B01 to check if a cycle of copying operation is currently in progress in the duplicator module 30. If the answer for this step B01 is given in the affirmative, the first microprocessor unit 300 reverts to the main routine program of FIG. 7 without completing this subroutine program A03. If it is found at step B01 that there is no cycle of copying operation currently in progress in the duplicator module 30, the step B01 is followed by another decision step B02 at which it is tested whether or not there is a signal $S_{SZ}$ produced with the print sheet size select switch 212 depressed on the main control panel 200. If it is found at this step B02 that there is no such signal $S_{SZ}$ present, the microprocessor unit 300 also reverts to the main routine program of FIG. 7 without completing this subroutine program A03.

In the presence detected of the signal $S_{SZ}$, it is confirmed at subsequent step B03 whether or not the third indicator 212*c* associated with the print sheet supply select switch 212 is turned on to indicate that the lower print sheet supply cassette 84 is currently selected for use. If the answer for this step B03 is given in the affirmative, the microprocessor unit 300 outputs at step B04 a signal to select the upper print sheet supply cassette 86. If it is found at the step B03 that the upper print sheet supply cassette 86 is currently selected for use, the step B03 is followed by step B05 at which the microprocessor unit 300 outputs a signal to select the lower print sheet supply cassette 86. With the lower or upper print sheet supply cassette 84 or 86 selected at step B04 or step B05, respectively, either the four-bit binary coded print sheet size signal $S_{C1}$ indicative of the A4 size of the print sheets stored in the lower cassette 84 or the four-bit binary coded print sheet size signal $S_{C2}$ indicative of the size of the print sheets stored in the upper cassette 86 is loaded into a register incorporated in the microprocessor unit 300 or into the memory 316 associated with the microprocessor unit 300.

Subsequently to the step B04 or B05, the microprocessor unit 300 proceeds to a print sheet size code conversion subroutine program B06 through which either the binary coded print sheet size signal $B_{PS1}$ or the binary coded print sheet size signal $B_{PS2}$ which has been loaded into the microprocessor unit 300 or the associated memory 316 is converted into actual size indicated by the signal. In this instance, the size of a print sheet is defined in terms of the length (or vertical measurement) and width (or horizontal measurement) of the print sheet as will be described in more detail.

Upon termination of the print sheet size code conversion subroutine program B06, the first microprocessor unit 300 proceeds to step B07 and outputs a signal to turn on the third or fourth indicator 212*c* or 212*d* corresponding to the print sheet supply cassette 84 or 86 selected at the step B04 or step B05, respectively. Thereafter, the first microprocessor 300 returns to the main program described with reference to FIG. 7 and may proceed to the copying operation control subroutine program A04 included in the main routine program as will be hereinafter described with reference to FIGS. 10A to 10C.

Print-Sheet Size Code Conversion Subroutine Program (B06)

Figure 9:
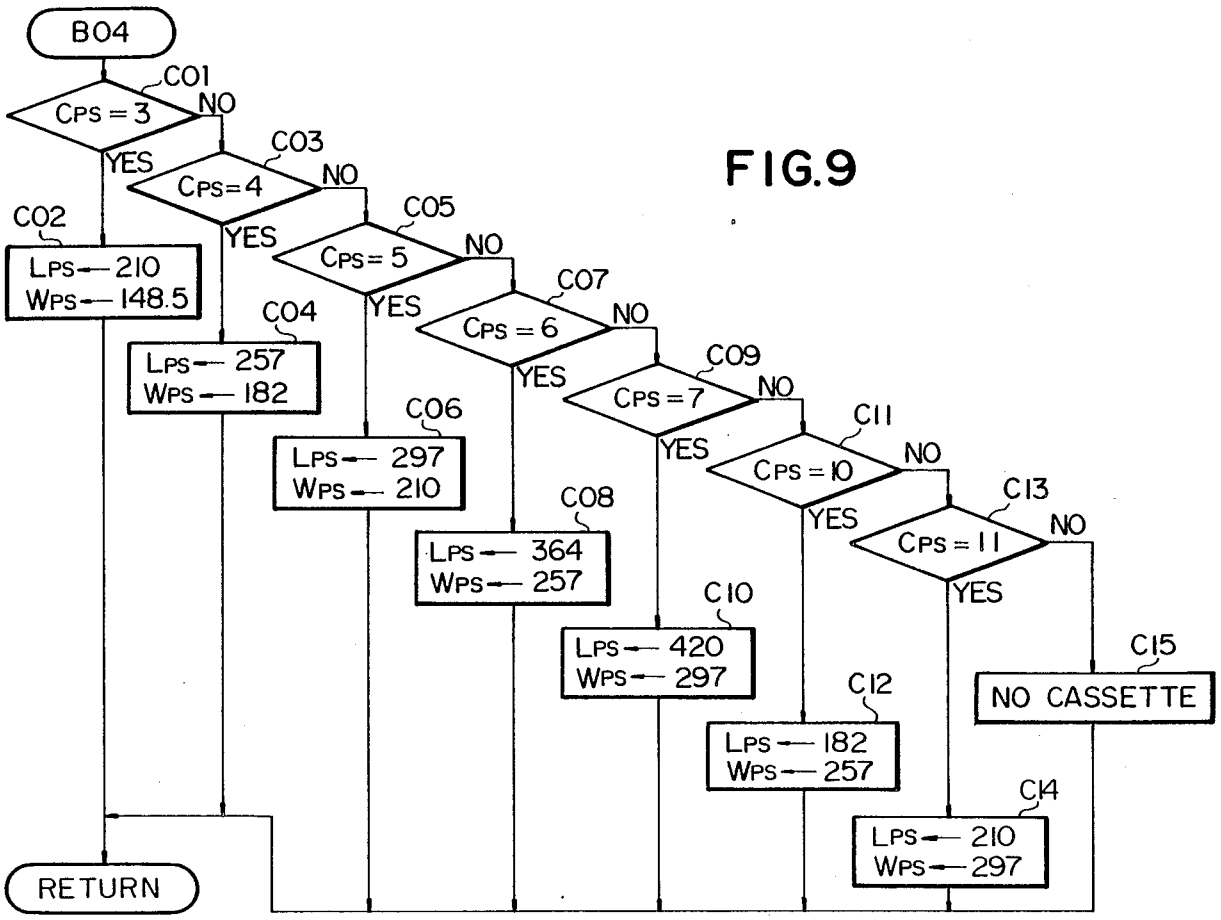
FIG. 9 is a flowchart showing the details of a print sheet size code conversion subroutine program included in the routine program illustrated in FIG. 8.

FIG. 9 shows the details of a preferred example of the print sheet size code conversion subroutine program B06 included in the print sheet size select control subroutine program A03 hereinbefore described with reference to FIG. 8. The print sheet size code conversion subroutine program B10 is executed to convert a binary coded print sheet size signal $B_{PS}$ into a print sheet size defined in terms of the length or vertical measurement $L_{PS}$ and width or horizontal measurement $W_{PS}$ of the print sheet as above noted. Table II demonstrates examples of the four-bit bit sequences of such a print sheet size signal and the hexadecimal print sheet size codes $C_{PS}$ respectively assigned to the four-bit notations for various print sheet sizes including the standard A5, B5, A4, B4, A3, B5 and A4 sizes. In table II are further shown the four-bit bit sequence and hexadecimal print sheet size code which indicate the absence of print sheets stored in a print sheet supply cassette. The indications (V) and (H) following the notations of the standard sizes refer to the vertical and horizontal positioning, respectively, of the sheets.

TABLE II

| Hex. Code ($C_{PS}$) | Sheet Size Signal ($B_{PS}$) | | | | Size of Sheets | | |
|---|---|---|---|---|---|---|---|
| | | | | | Notation | Length | Width |
| 0 | 0 | 0 | 0 | 0 | (Reserved) | | |
| 1 | 0 | 0 | 0 | 1 | (Reserved) | | |
| 2 | 0 | 0 | 1 | 0 | (Reserved) | | |
| 3 | 0 | 0 | 1 | 1 | "A5" (V) | 210 | × 148.5 |
| 4 | 0 | 1 | 0 | 0 | "B5" (V) | 257 | × 182 |
| 5 | 0 | 1 | 0 | 1 | "A4" (V) | 297 | × 210 |
| 6 | 0 | 1 | 1 | 0 | "B4" (V) | 364 | × 257 |
| 7 | 0 | 1 | 1 | 1 | "A3" (V) | 420 | × 297 |
| 8 | 1 | 0 | 0 | 0 | (Reserved) | | |
| 9 | 1 | 0 | 0 | 1 | (Reserved) | | |
| 10 | 1 | 0 | 1 | 0 | "B5" (H) | 182 | × 257 |
| 11 | 1 | 0 | 1 | 1 | "A4" (H) | 210 | × 297 |
| 12 | 1 | 1 | 0 | 0 | (Reserved) | | |
| 13 | 1 | 1 | 0 | 1 | (Reserved) | | |
| 14 | 1 | 1 | 1 | 0 | (Reserved) | | |
| 15 | 1 | 1 | 1 | 1 | No print sheet stored | | |

Now, the print sheet size code conversion subroutine program B06 shown in FIG. 9 starts with a decision step C01 at which it is tested whether or not the hexadecimal print sheet sizer code $C_{PS}$ currently stored in the microprocessor unit 300 or the memory 316 associated therewith is "3" which is representative of the vertical A5 size. If the print sheet size code $C_{PS}$ is found to be "3" at this step C01, then the microprocessor unit 300 proceeds to step C02 and stores into the memory 316 data indicating the length $L_{PS}$ of 210 mm and the width $W_{PS}$ of 148.5 mm of A5 size print sheets. If it is determined at step C01 that the print sheet size code C is not "3", then the step C01 is followed by step C03 at which it is tested whether or not the print sheet size code CPS currently stored in the microprocessor unit 300 or the memory 316 is "4" which is representative of the vertical B5 size. If the print sheet size code $C_{PS}$ is found to be "4" at this step C03, then the microprocessor unit 300 proceeds to step C02 and stores into the memory 316 data indicating the length $L_{PS}$ of 257 mm and the width $W_{PS}$ of 182 mm of B5 size print sheets.

If it is determined at step C03 that the print sheet size code $C_{PS}$ is not "4", then the step C03 is followed by step C05 at which it is tested whether or not the print sheet size code $C_{PS}$ currently stored in the microprocessor unit 300 or the memory 316 is "5" which is representative of the vertical A4 size. If the print sheet size code $C_{PS}$ is found to be "5" at this step C05, then the microprocessor unit 300 proceeds to step C06 and stores into the memory 316 data indicating the length $L_{PS}$ of 297 mm and the width $W_{PS}$ of 210 mm of A4 size print sheets If it is determined at step C05 that the print sheet size code $C_{PS}$ is not "5", then the step C05 is followed by step C07 at which it is tested whether or not the print sheet size code $C_{PS}$ currently stored in the microprocessor unit 300 or the memory 316 is "6" which is representative of the vertical B4 size. If the print sheet size code $C_{PS}$ is found to be "6" at this step C07, then the microprocessor unit 300 proceeds to step C08 and stores into the memory 316 data indicating the length $L_{PS}$ of 364 mm and the width $W_{PS}$ of 257 mm of B4 size print sheets.

If it is determined at step C07 that the print sheet size code $C_{PS}$ is not "6", then the step C07 is followed by step C09 at which it is tested whether or not the print sheet size code $C_{PS}$ currently stored in the microprocessor unit 300 or the memory 316 is "7" which is representative of the vertical A3 size. If the print sheet size code $C_{PS}$ is found to be "7" at step C09, then the microprocessor unit 300 proceeds to step C10 and stores into the memory 316 data indicating the length $L_{PS}$ of 420 mm and the width $W_{PS}$ of 297 mm of A3 size print sheets. If it is determined at step C09 that the print sheet size code $C_{PS}$ is not "7", then the step C09 is followed by step Cll at which it is tested whether or not the print sheet size code $C_{PS}$ currently stored in the microprocessor unit 300 or the memory 316 is "10" which is representative of the horizontal B5 size. If the print sheet size code $C_{PS}$ is found to be "10" at this step C11, then the microprocessor unit 300 proceeds to step C12 and stores into the memory 316 data indicating the length $L_{PS}$ of 182 mm and the width $W_{PS}$ of 257 mm of horizontal B5 size print sheets.

If it is determined at step Cll that the print sheet size code $C_{PS}$ is not "10", then the step C11 is followed by step C13 at which it is tested whether or not the print sheet size code $C_{PS}$ currently stored in the microprocessor unit 300 or the memory 316 is "11" which is representative of the horizontal A4 size. If the print sheet size code $C_{PS}$ is found to be "11" at this step C13, then the microprocessor unit 300 proceeds to step C14 and stores into the memory 316 data indicating the length $L_{PS}$ of 210 mm and the width $W_{PS}$ of 297 mm of horizontal A4 size print sheets. If it is determined at step C13 that the print sheet size code $C_{PS}$ is not "11", it is determined that there is no print sheet supply cassette assembled into the duplicator module 30 and as such the step C13 is followed by step C14 at which the microprocessor unit 300 stores into the memory 316 data indicating that there currently is no print sheet supply cassette available in the duplicator module 30.

Subsequently to any of the process steps C02, C04, C06, C08, C10, C12, C14 and C15, the first microprocessor unit 300 reverts to the subroutine program A03 described with reference to FIG. 8 and may proceed to the step B07 included in the subroutine program A03.

Copying Operation Control Subroutine (A04)

Figure 10A:
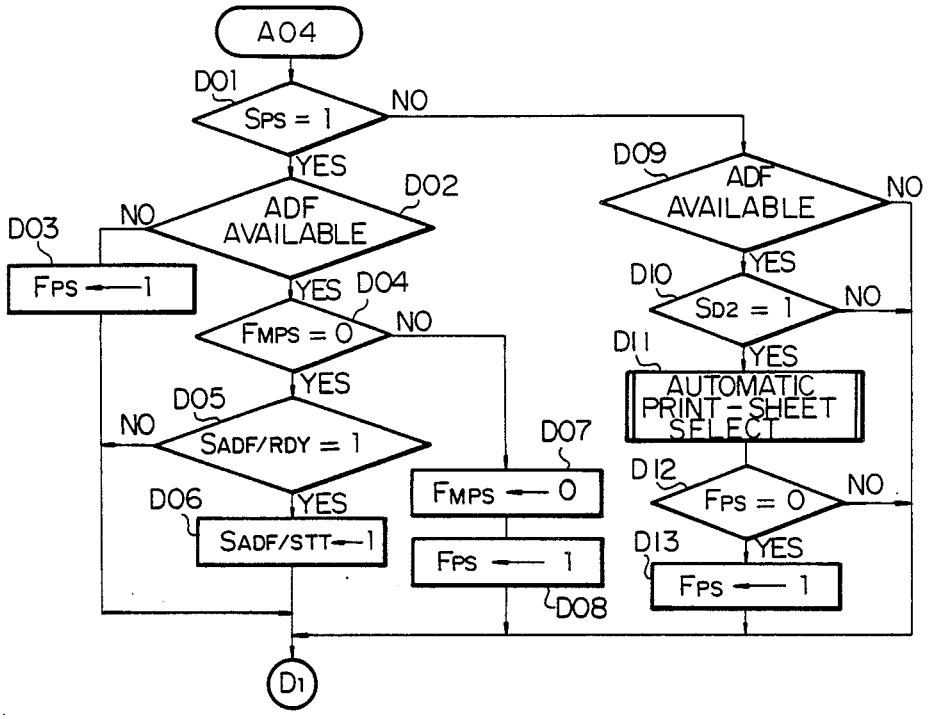
FIGS. 10A, 10B and 10C are flowcharts showing the details of a copying operation control subroutine program also included in the main routine program illustrated in FIG. 7.
Figure 10B:
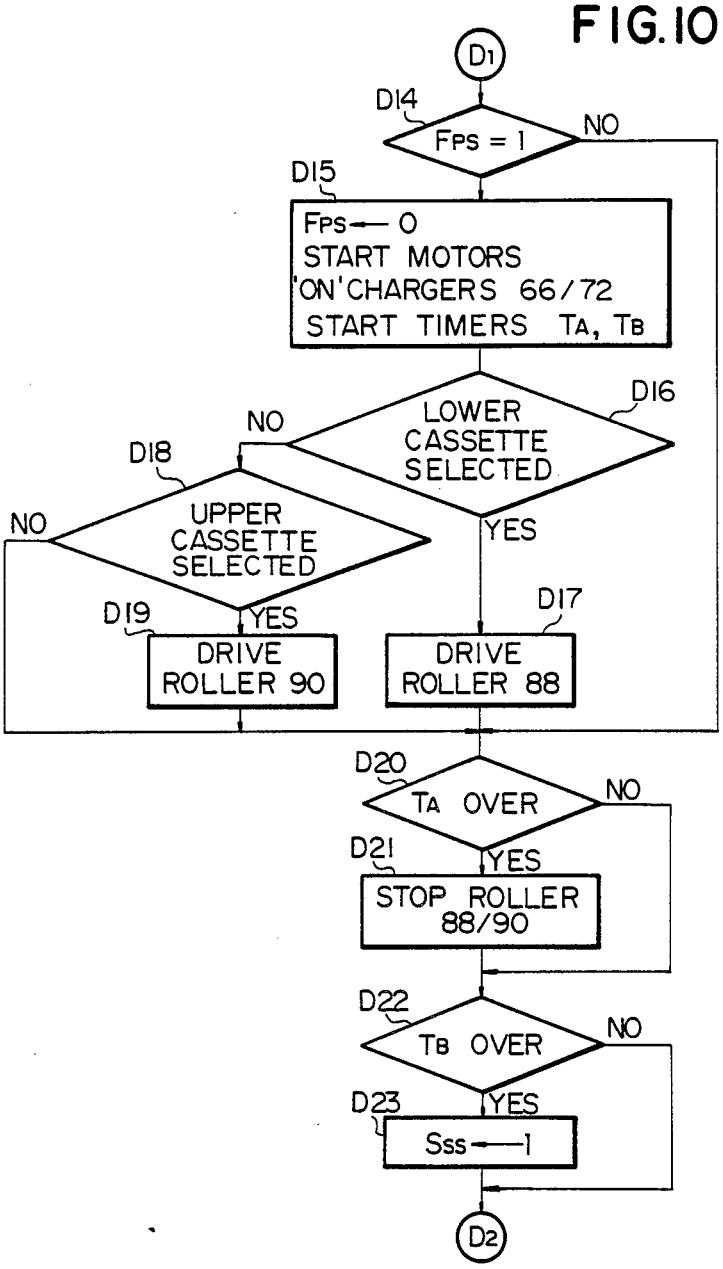
Figure 10C:
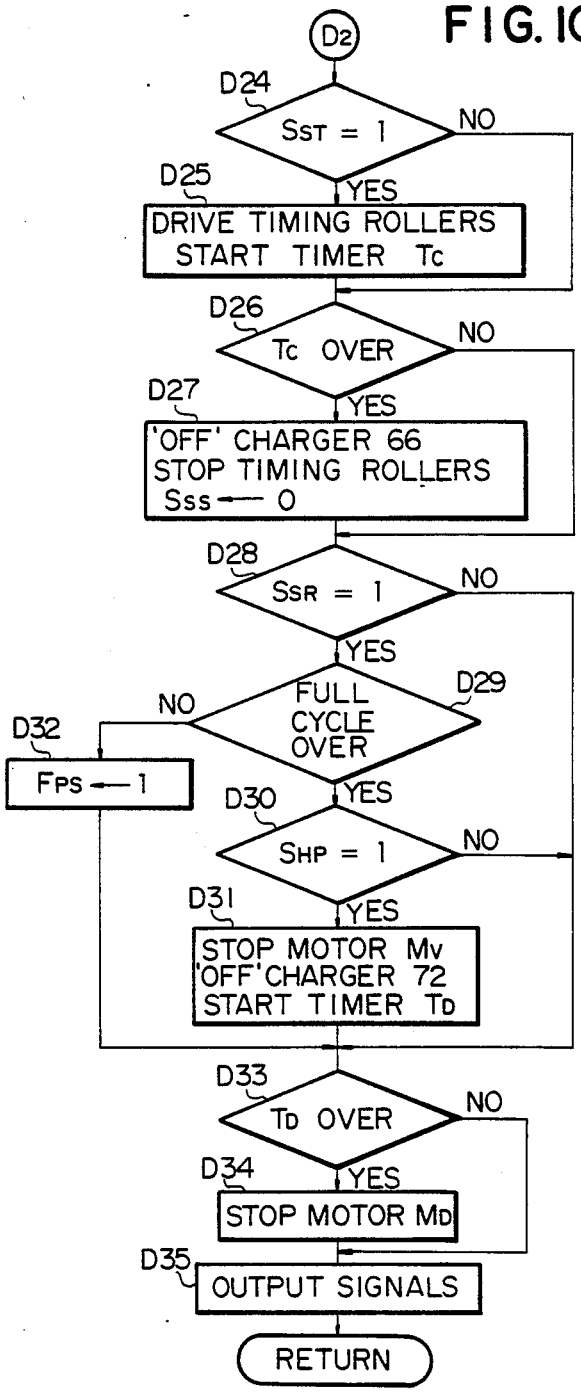

FIG. 10A, 10B and 10C show the details of a preferred example of the copying operation control subroutine program A04 included in the main routine program hereinbefore described with reference to FIG. 7.

As shown in FIG. 10A, the copying operation control subroutine program A04 starts with a decision step D01 to determine whether or not there is a signal $S_{PS}$ of logic "1" state produced with the print start key 202 depressed. If it is found at this step D01 that this is the case, it is further checked at step D02 whether or not the duplicating apparatus to be controlled is equipped with an automatic document feed module (ADF). If the answer for this step D02 is given in the negative, the microprocessor unit 300 proceeds to step D03 to set a print-start flag $F_{PS}$ of logic "1" state. If it is found at step D02 that the automatic document feed module 32 is available in the apparatus to be controlled, it is further tested at step D04 whether or not a manual print sheet supply flag $F_{MPS}$ has been reset to logic "0" state which means that one of the print sheet supply cassettes 84 and 86 is selected. As will be described later, this manual print sheet supply flag $F_{MPS}$ is set to logic "1" state when none of the print sheet supply cassettes 84 and 86 is selected (step E06 of subroutine program D11).

When it is thus proved that the automatic document feed module 32 is available and one of the print sheet supply cassettes 84 and 86 is selected, the microprocessor unit 300 proceeds to another decision step D05 to check if an automatic document feed ready signal $S_{ADF/RDY}$ is of a logic "1" value indicating that the automatic document feed module 32 is now ready for operation. This automatic document feed ready signal $S_{ADF/RDY}$ of logic "1" value is effective to grant the first microprocessor unit 300 to output signals necessary for starting a cycle of copying operation.

If the answer for this decision step D05 is given in the affirmative, the step D05 is followed by step D06 at which an automatic document feed start signal $S_{ADF/STS}$ is set to a logic "1" state it is found at step D04 that the manual print sheet supply flag $F_{MPS}$ has been set to logic "1" state with none of the print sheet supply cassettes 84 and 86 selected, the step D04 is followed by step D07 to reset the manual print sheet supply flag $F_{MPS}$ to logic "0" state. Subsequently to this step D07, the microprocessor unit 300 proceeds to step D08 to set the print-start flag $F_{PS}$ to logic "1" state.

If it is found at the step D01 that there is no signal $S_{PS}$ produced with the print start switch 202 depressed, it is further checked at decision step D09 whether or not the duplicating apparatus to be controlled is equipped with an automatic document feed module. If the answer for this step D09 is given in the affirmative, it is further confirmed at step D10 whether or not the signal $S_{D2}$ of a logic "1" state is output from the document-on-the-table sensor 184 in the presence of an original document on the document support table 40. When it is determined at this step D10 that the signal $S_{D2}$ of logic "1" state is present, the microprocessor unit 300 executes an automatic print sheet select subroutine program D11 to select one of the lower and upper print sheet supply cassettes 84 and 96 for use or set the above mentioned manual print sheet supply flag $F_{MPS}$ to logic "1" state. The details of this automatic print sheet select subroutine program D11 will be hereinafter described with reference to FIG. 11.

Upon termination of the automatic print sheet select subroutine program D11, the microprocessor unit 300 proceeds to step D12 to detect whether or not the manual print sheet supply flag $F_{MPS}$ is currently of logic "0" state. If the answer for this decision step D12 is given in the affirmative in the presence of the manual print sheet supply flag $F_{MPS}$ of logic "0" state, the step D12 is followed by step D13 at which the print-start flag $F_{PS}$ is set to logic "1" state.

Subsequently to the step D03, D06, D08 or D13 or when the answer for the decision step D05, D10 or D12 is given in the negative, the microprocessor unit 300 proceeds to the series of steps shown in FIG. 10B. Thus, the microprocessor unit 300 proceeds to step D14 to detect whether or not there is the print-start flag $F_{PS}$ of logic "1" state. If it is found at this step D14 that there is present the print-start flag $F_{PS}$ of logic "1" state, then the print-start flag $F_{PS}$ is reset to logic "0" state at step D15 in which the microprocessor unit 300 further outputs signals to activate the various driver and actuator circuits included in or associated with the image reproducing system 40 of the duplicator module 30. These driver and actuator circuits include the driver circuits for the main drive motor 64 ($M_D$), the developer drive motor 70 ($M_V$), the actuators for the main and transfer chargers 66 and 72, and so on. In addition, first and second system timers, "$T_A$" and "$T_B$", included in the microprocessor unit 300 are activated to start counting operation. By the first system timer "$T_A$" is prescribed the timing at which the solenoid-operated clutch for the print sheet feed roller 88 or 90 associated with the lower or upper print-sheet supply cassette 84 or 86, respectively, is to be de-energized. By the second system timer "$T_B$" is prescribed the timing at which the document scanner 46/48 is to be initiated into motion to scan the original document placed on the document support table 12.

The step D15 is followed by a decision step D16 at which is detected whether or not the lower print-sheet supply cassette 84 has been selected for use in the cycle of operation started. If it is found at this step D16 that this is the case, the microprocessor unit 300 outputs a signal at step D17 to actuate the clutch for the print sheet feed roller 88 associated with the lower print-sheet supply cassette 84. If it is determined at the step D16 that the lower print-sheet supply cassette 84 has not been selected for use, it is checked at another decision step D18 whether or not the upper print-sheet supply cassette 86 has been selected for use. If the answer for this step D18 is given in the affirmative, the microprocessor unit 300 outputs at step D19 a signal to actuate the clutch for the print sheet feed roller 90 associated with the upper print-sheet supply cassette 86.

Subsequently to the step D17 or step D19 or if it is found at the step D03 that there is present no print-start flag $F_{PS}$ of logic "1" state or at step D18 that the upper print-sheet supply cassette 86 has not been selected, it is tested at step D20 whether or not the first system timer "$T_A$" has terminated its counting operation. When the answer for this decision step D20 is given in the affirmative, the microprocessor unit 300 outputs at step D21 a signal to de-activate the clutch for the print sheet feed roller 88 or 90 associated with the selected print-sheet supply cassette 84 or 86. Subsequently to this step D21 or when it is determined at step D20 that the system timer "$T_A$" is still in operation, it is checked at step D22 whether or not the time prescribed on the second system timer "$T_B$" has elapsed. If the answer for this step D22 is given in the affirmative, the microprocessor unit 300 outputs a scan start signal $S_{SS}$ of logic "1" state at step D23. This scan start signal $S_{SS}$ is supplied from the first microprocessor unit 300 to the second microprocessor unit 302 which, in response to the signal $S_{SS}$, outputs a signal to initiate the optical scanning system 38 into operation to scan the original document placed on the document support table 12.

Subsequently to step D23 or when it is found at step D22 that the second system timer "$T_B$" is still in operation, the microprocessor unit 300 proceeds a series of steps illustrated in FIG. 10C. Thus, the microprocessor unit 300 proceeds to a decision step D24 to confirm whether or not there is present the scan timing signal $S_{ST}$ of logic "1" state. This scan timing signal $S_{ST}$ is produced by the scan timing sensor 90 provided in the optical scanning system 38 and is relayed from the second microprocessor unit 302 to the first microprocessor unit 300. When it is determined at step D24 that there is present the scan timing signal of logic "1" state, then the first microprocessor unit 300 outputs at step D25 a signal to energize the clutch for the timing rollers 100. The timing rollers 100 are now driven for rotation so that the print sheet which has been supplied from the print-sheet supply cassette 84 or 86 is allowed to travel past the timing rollers 100 into contact with the image transfer drum 62. The toner particles which have been applied to the peripheral surface of the image transfer drum 62 are transferred to the surface of the copy sheet by means of the image transfer charger 72. At the step D25 is further started a third system timer, "$T_C$", which dictates the timing at which the scanning operation is to be terminated, the timing at which the actuator circuit for the main charger 66 is to be de-energized, and the timing at which the clutch for the timing rollers 100 is to be de-energized.

It is then tested at decision step D26 whether or not the timing preset by the third system timer "$T_C$" has been reached. If the answer for this step D26 is given in the affirmative, the microprocessor unit 300 outputs at step D27 signals to cause the scanning system 40 to terminate the operation and de-activate the actuator circuit for the main charger 66 and the clutch for the timing rollers 100. In addition, the scan start signal $S_{SS}$ is reset to logic "0" state at this step D27.

Subsequently to step D27 or when it is determined at step D26 that the timing dictated by the third system timer "$T_C$" has not yet been reached, the microprocessor unit 300 proceeds to decision step D28 to detect whether or not there is present a scanner return signal $S_{SR}$ of logic "1" state supplied from the second microprocessor unit 302. If the document scanner 46/48 is on the way back to its home position so that the scanner return signal $S_{SR}$ is of logic "1" state, it is further tested at decision step D29 whether or not a full cycle of copying operation is complete with a required number of printing steps repeated. If it is found at step D29 that this is the case, then it is further tested at step D30 whether or not the document scanner 46/48 has reached its initial home position. This test is made on the basis of the signal $S_{HP}$ produced by the home position sensor 118 and supplied to the microprocessor unit 300 from the second microprocessor 202. If the answer for step D29 is given in the affirmative in the presence of the signal $S_{HP}$ of logic "1" state, the microprocessor unit 300 outputs at step D31 a signal to bring the developer drive motor 70 to a stop and de-activate the actuator circuit for the image transfer charger 72. At step D31 is further started a fourth system timer, "$T_D$", which dictates the timing at which the main drive motor 64 is to be brought to a stop.

If it is found at the previous step D29 that the full cycle of copying operation is still incomplete, the step D29 is followed by step D32 at which the print-start flag $F_{PS}$ is set to logic "1" state for a second time. Subsequently to the step D31 or step D32 or if it is determined at step D28 that the scanner return signal $S_{SR}$ is of logic "0" state or at step D30 that the document scanner 46/48 has not yet reached its initial home position, the microprocessor unit 300 proceeds to step D33 to detect whether or not the time interval set on the fourth system timer "$T_D$" has elapsed. If it is found at this step D33 that the time interval set on the fourth system timer "$T_D$" has elapsed, the microprocessor unit 300 outputs at step D34 a signal to bring the main drive motor 64 to a stop. The step D34 is followed by step D35 at which the microprocessor unit 300 outputs control signals to be supplied to the individual functional elements and units of the duplicator module 30 to enable the elements or units to operate as scheduled by this subroutine program A04. Upon completion of the process step D35, the first microprocessor unit 300 returns to the main routine program of FIG. 7 and may proceed to the subroutine program A05 included in the main routine program.

Automatic Print Sheet Select Control Subroutine Program (D11)

Figure 11:
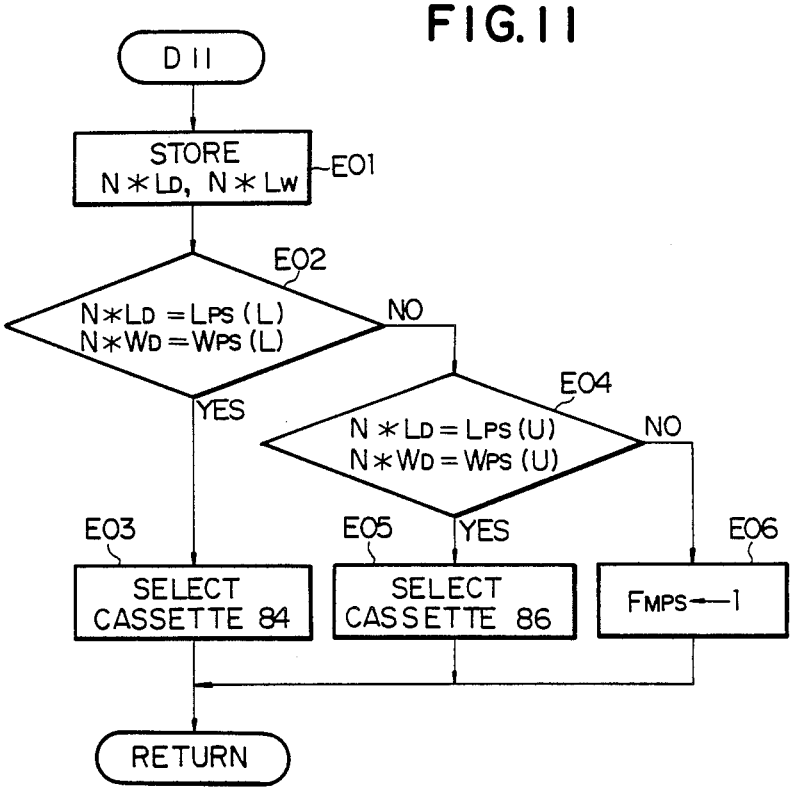
FIG. 11 is a flowchart showing the details of an automatic print sheet select subroutine program included in the copying operation control routine program illustrated in FIGS. 10A to 10C.

FIG. 11 shows the details of the automatic print sheet select subroutine program D11 included in the copying operation control subroutine program A04 hereinbefore described with reference to FIGS. 10A to 10C.

As shown in FIG. 11, the automatic print sheet select subroutine program Dll starts with step E01 at which data indicating the products of multiplication of the selected size (defined by the length $L_D$ and width $W_D$) of the original document to be duplicated and the selected magnification ratio N for copying are loaded into a register, herein referred to as register "A" in the microprocessor unit 300. The step E01 is followed by a decision step E02 at which the values ($N*L_D$, $N*W_D$) represented by the data thus stored in the register "A" are compared with the values ($L_{PS}$, $W_{PS}$) indicating the size of the print sheets stored in the lower print sheet supply cassette 84. If it is determined at this step E02 that the values represented by the data stored in the register "A" are identical with the values indicating the size of the print sheets stored in the cassette 84, the microprocessor unit 300 outputs at step E03 a signal to select the lower print sheet supply cassette 84 for use in duplicating the original document currently present on the document support table 36.

If it is found at step E02 that the values represented by the data stored in the register "A" are not in conformity to the values indicating the size of the print sheets stored in the lower print sheet supply cassette 84, the step E02 is followed by another decision step E04 at which the values represented by the data stored in the register "A" are compared with the values indicating the size of the print sheets stored in the upper print sheet supply cassette 86. If it is determined at this step E04 that the values represented by the data stored in the register "A" are identical with the values indicating the size of the print sheets stored in the cassette 86, the microprocessor unit 300 proceeds to step E05 and outputs a signal to select the upper print sheet supply cassette 86 for use.

If it is found at step E04 that the values represented by the data stored in the register "A" are not in conformity to the values indicating the size of the print sheets stored in the upper print sheet supply cassette 86, the step E04 is followed by step E06 at which the manual print sheet supply flag $F_{MPS}$ is set to logic "1" state which means that none of the print sheet supply cassettes 84 and 86 is currently selected.

Subsequently to any of the steps E02, E05 and E06, the microprocessor unit 300 reverts to the step D11 of the copying operation control subroutine program A04 described with reference to FIGS. 10A to 10C and may proceed to the step D11 included in the subroutine program A04.

Main Routine Program for MPU3

Figure 12:
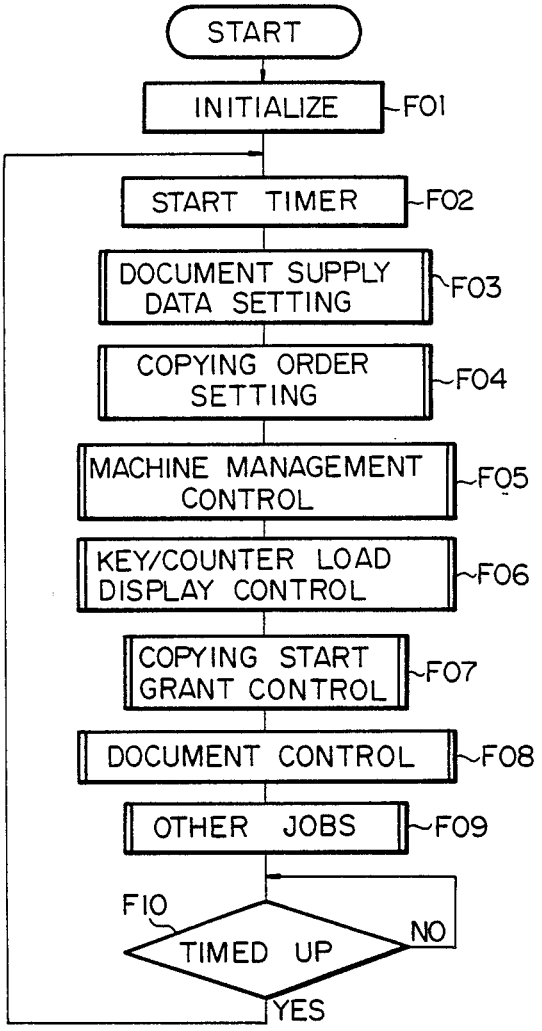
FIG. 12 is a flowchart showing a preferred example of the main routine to be executed by a slave microprocessor unit included in the control circuit illustrated in FIGS. 6A and 6B.

FIG. 12 shows a preferred example of the main routine program to be executed by the third microprocessor unit 304 included in the control circuit described with reference to FIGS. 6A and 6B.

The routine program starts with a step F01 for initializing the third microprocessor unit 304. All the data representative of the document feeding conditions that may have been memorized in the internal registers and associated memory of the microprocessor unit 304 are thus initialized in accordance with prescribed default rules. An internal timer of the microprocessor unit 304 is then started at a step F02 to count the time interval predetermined for a single complete iteration through the routine program.

The third microprocessor unit 304 is predominant over the operation of the automatic document feed module 32 and further has a document supply data setting subroutine program F03 to set the various pieces of document supply data to be stored into the memory 330 associated with the third microprocessor unit 304. These pieces of data include those relating to the presence or absence of an original document in each of the document supply units 140*a* to 140*c*, whether or not a cycle of copying operation is in progress with use of each of the document supply units 140*a* to 140*c*, the order in which the document supply units 140*a* to 140*c* are to be put to use in succession, the quantity of printed outputs to be produced for each of the document supply units 140*a* to 140*c*, and the size of the original documents to be supplied from each of the document supply units 140*a* to 140*c*. Briefly, the document supply data setting subroutine program F03 is executed for the purpose of preparing the memory map indicated in Table I. The details of a preferred example of this document supply parameter determination subroutine program F03 will be hereinafter described with reference to FIGS. 14 and 15.

Upon termination of the subroutine program F03, the third microprocessor unit 304 may proceed to an automatic copying order shift control subroutine program F04 through which the third microprocessor unit 304 grants the first microprocessor unit 300 to output signals necessary for starting a cycle of copying operation with use of the current first-order document supply unit on condition that print sheets of the size required by the size of the original document set in the current first-order document supply unit are available in one of the print sheet supply cassettes 84 and 86 in the duplicator module 30. If print sheets of the required size are not available in any of the print sheet supply cassettes 84 and 86, then the document supply unit which has been registered as the current second-order document supply unit is registered as a new first-order document supply unit and is selected for use on condition that whether or not print sheets of the size required by the original documents set in the second-order document supply unit are available in one of the print sheet supply cassettes 84 and 86. The details of a preferred example of this automatic copying order shift control subroutine program F04 will be hereinafter described with reference to FIG. 16.

The third microprocessor unit 304 may then proceed to a machine management control subroutine program F05 through which the microprocessor unit 304 increments the count of printed outputs registered in the key/counter 190 set in the socket compartment 188 of the currently selected document supply unit if the key/counter 190 is found loaded into the particular document supply unit. In the absence of the key/counter 190 set in the currently selected document supply unit, the microprocessor unit 304 increments the count of printed outputs registered in the key/counter 190 which was used for the copying of the original document or the stack of original documents set in the document supply unit which had been selected immediately before the currently selected document supply unit was selected, provided the user of the apparatus to whom the original document or the stack of original documents set in the selected document supply unit belongs is identical with the user to whom the original document or the stack of the original documents set in the document supply unit which had been selected immediately before the currently selected document supply unit was selected. The details of a preferred example of this machine management control subroutine program F05 will be hereinafter described with reference to FIG. 17.

Upon termination of the machine management control subroutine program F05, the third microprocessor unit 304 may execute a key/counter load display control subroutine program F06 to activate the key/counter load indicator 234 on the control panel 196 of the currently selected document supply unit if the key/counter 190 is found loaded into the particular document supply unit. In the absence of the key/counter 190 set in the currently selected document supply unit, the microprocessor unit 304 activates the key/counter load indicator 234 on the control panel 196 of the document supply unit which had been selected immediately before the currently selected document supply unit was selected, provided the user of the apparatus to whom the original document or the stack of original documents set in the selected document supply unit belongs is identical with the user to whom the original document or the stack of the original documents set in the document supply unit which had been selected immediately before the currently selected document supply unit was selected. The details of a preferred example of this key/counter load display control subroutine program F06 will be hereinafter described with reference to FIG. 18.

Upon termination of the key/counter load display control subroutine program F06, the third microprocessor unit 304 may proceed to a copying operation start grant control subroutine program F07 through which to grant the duplicator module 30 to start a cycle of printing operation provided there is the key/counter 190 loaded into either the currently selected document supply unit or the document supply unit which had been selected immediately before the currently selected document supply unit was selected. The details of a preferred example of this copying operation start grant control subroutine program F07 will be hereinafter described with reference to FIG. 19.

Subsequently to the a copying operation start grant control subroutine program F07, the third microprocessor unit 304 may proceed to a document control subroutine program F08. This document control subroutine program F09 is executed to control the operation of the automatic document feed module 32 to supply an original document from the document supply assembly 140 to the correct exposure position on the document support table 36, transport the original document through the document transport assembly 142 after the original document has been scanned by the optical scanning system 38, and discharge the original document out of the document transport assembly 144.

The third microprocessor unit 304 may then proceed to subroutine program F09 to perform various other jobs required for the automatic feeding of an original document or original documents. When it is thereafter confirmed at step F10 that the time set at step F02 has lapsed, then the routine program for the automatic document feed module 32 recycles to the step F02. Details of the document control subroutine program F08 will be hereinafter described with reference to FIGS. 20A and 20B.

Figure 13:
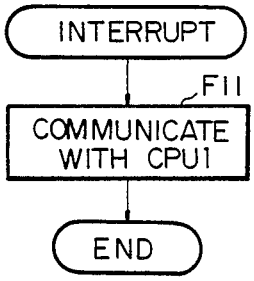
FIG. 13 is a showing the details of an interrupt control subroutine program through which the main microprocessor unit may interrupt the main routine program illustrated in FIG. 12.

Communication of data between the first microprocessor unit 300 and each of the second and third microprocessor units 302 and 304 is effected on the basis of an interrupt request signal output from the first microprocessor unit 300 independently of the routine program herein shown. FIG. 13 shows a subroutine program which the third microprocessor unit 304 is to execute when interrupted by the first microprocessor unit 300. Through this subroutine program, the third microprocessor unit 304 communicates with the first microprocessor unit 300 as at step Fll when interrupted by the first microprocessor unit 300.

Document Supply Data Setting Subroutine Program (F03)

Figure 14:
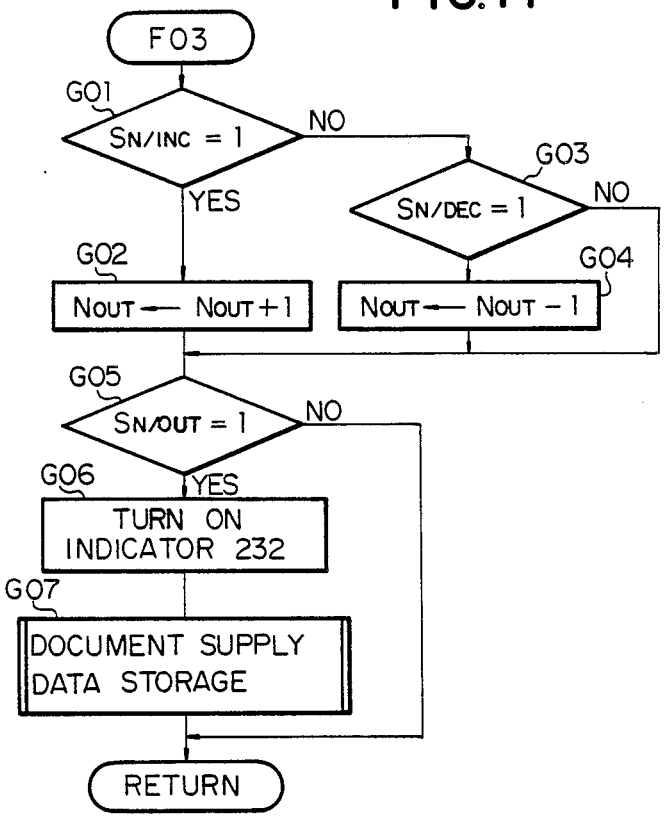
FIG. 14 is a flowchart showing the details of a document supply data setting subroutine program included in the main routine program illustrated in FIG. 12.

FIG. 14 shows the details of a preferred example of the document supply data setting subroutine program F03 included in the main routine program hereinbefore described with reference to FIG. 12.

The document supply data setting subroutine program F03 is executed to prepare data for the quantity of printed outputs $N_{OUT}$ to be stored in the memory map indicated in Table I and starts with a decision step G01 to check if there currently is a signal $S_{N/INC}$ of a logic "1" state produced by depression of the print quantity increment key 224 of the control panel 196 of any of the document supply units 140*a*, 140*b* and 140*c* of the automatic document feed module 32 (FIG. 5). In the presence detected of such a signal $S_{N/INC}$, the step G01 is followed by step G02 to increment the numerical value $N_{OUT}$ indicated in the display window 228 of the particular control panel 196.

If it is determined at step G01 that there is no such signal $S_{N/INC}$ currently present, then the step G01 is followed by step G03 to check if there currently is a signal $S_{N/DEC}$ of a logic "1" state produced by depression of the print quantity decrement key 226 of the control panel 196 of any of the document supply units 140*a*, 140*b* and 140*c*. In the presence detected of such a signal $S_{N/DEC}$, the step G03 is followed by step G04 to decrement the numerical value $N_{OUT}$ indicated in the display window 228 of the particular control panel 196.

Subsequently to the step G02 or step G04 or when it is found at step G03 that there is a signal $S_{N/DEC}$ of logic "1" state produced from the print quantity decrement key 226 of the control panel 196 of none of the document supply units 140*a*, 140*b* and 140*c*, the third microprocessor unit 304 proceeds to step G05 to detect whether or not there is a signal $S_{N/OUT}$ of a logic "1" state produced from the print quantity enter key 230 of the control panel 196 of any of the document supply units 140*a*, 140*b* and 140*c*. If the answer for this decision step G05 is given in the affirmative, the step G05 is followed by step G06 a which the microprocessor unit 304 outputs a signal to activate the indicator 232 associated with the particular print quantity enter key 230. After the indicator 232 is thus activated to turn on, the microprocessor unit 304 proceeds to a document supply data storage control G07, the details of which will be hereinafter described with reference to FIG. 15. Upon termination of the subroutine program G07, the third microprocessor unit 304 reverts to the main routine program described with reference to FIG. 12 and may proceed to the automatic copying order shift control subroutine program F04 included in the main routine program as will be hereinafter described with reference to FIG. 16.

Document Supply Data Storage Control Subroutine Program (G07)

Figure 15:
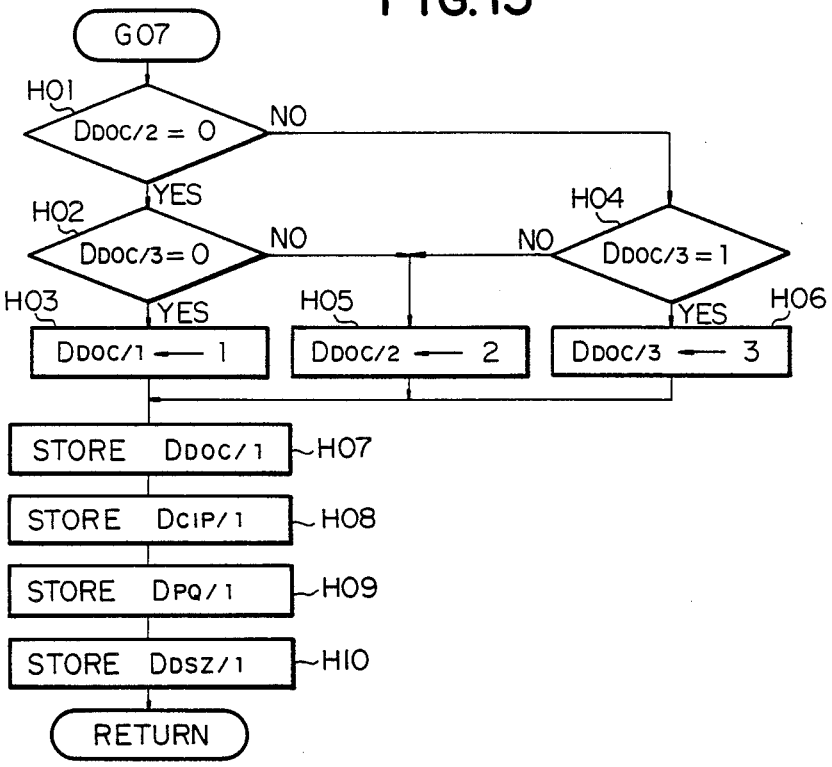
FIG. 15 is flowchart showing the details of a document supply storage data control subroutine program included in the document supply data setting routine program illustrated in FIG. 14.

FIG. 15 shows the details of a preferred example of the document supply data storage control subroutine program G07 included in the document supply data setting subroutine program hereinbefore described with reference to FIG. 14. In the following description regarding this subroutine program G07, it will be assumed by way of example that a set of original documents is placed in the first document supply unit 140*a* of the automatic document feed module 32. It may be further noted that the data relating to the document supply conditions and parameters of the document supply units 140*a*, 140*b* and 140*c* of the automatic document feed module 32 as memorized in the memory 330 incorporated in the third microprocessor unit 304 are accessed through designation of the addresses $D_1$, $D_2$ and $D_3$, respectively, of the memory 330, as has been noted in regard to Table 1.

As shown in FIG. 15, the document supply data storage control subroutine program G07 starts with a decision step H01 to check if the data $D_{DOC/2}$ stored in the document presence/absence data memory area corresponding to address $D_2$ of the memory 330 is of a logic value "0" indicative of the absence of an original document in the second document supply unit 140*b*. If it is found at this step H01 that the data $D_{DOC/2}$ is indicative of the absence of an original document in the second document supply unit 140*b*, it is further checked at step H02 whether or not the data $D_{DOC/3}$ stored in the document presence/absence data memory area corresponding to address $D_3$ of the memory 330 is of a logic value "0" indicative of the absence of an original document in the third document supply unit 140*c*. If it is found at this step H02 that the data $D_{DOC/3}$ is of a logic "0" value and is thus indicative of the absence of an original document in the third document supply unit 140*b*, it is determined that there is no original document in each of the second and third document supply units 140*b* and 140*c* and, as such, the step H02 is followed by step G03 at which data indicating the first order of copying "1" is loaded as the data $D_{CO/1}$ into the copying order data memory area corresponding to address $D_1$ of the memory 330.

If it is found at step H01 that the data $D_{DOC/2}$ is of a logic value "1" and is indicative of the presence of an original document in the second document supply unit 140*b*, it is further checked at step H04 whether or not the data $D_{DOC/3}$ stored in the document presence/absence data memory area corresponding to address $D_3$ of the memory 330 is of logic value "1" indicative of the presence of an original document in the second document supply unit 140*c*. If it is found at this step H04 that the data $D_{DOC/3}$ is not of logic "1" value, or if it is found at step H02 that the data $D_{DOC/3}$ is not of logic "0" value, it is determined that there is an original document in one of the second and third document supply units 140*b* and 140*c* in addition to the original document in the first document supply unit 140*a*. In this instance,, the step H04 is followed by step G05 at which data indicating the second order of copying "2" is loaded as the data $D_{CO/1}$ into the copying order data memory area corresponding to address $D_1$ in the memory 330, as is the case with the data indicated in Table I.

If it is found at step H04 that the data $D_{DOC/3}$ is of logic "1" value, it is determined that there are original documents in all of the first, second and third document supply units 140*a*, 140*b* and 140*c*. In this instance, the step H04 is followed by step G06 at which data indicating the third order of copying "3" is loaded as the data $D_{CO/1}$ into the copying order data memory area corresponding to address $D_1$ of the memory 330.

As will be understood from the above description, the order of copying, viz., the order in which the document supply units 140*a*, 140*b* and 140*c* of the automatic document feed module 32 are to be put use successively is determined not in accordance with any rule of priority but to be identical with the order in which original documents are loaded into the document supply units 140*a*, 140*b* and 140*c*.

After the order of copying with use of the first document supply unit 140*a* is determined in this fashion, the third microprocessor unit 304 proceeds to step H07 at which data of logic "1" value is stored as the data $D_{DOC/1}$ into the document presence/absence data memory area corresponding to address $D_1$ of the memory 330. The step H07 is followed by step H08 at which data of logic "0" value is stored as the data $D_{CIP/1}$ into the cycle-in-progress data memory area corresponding to address $D_1$ of the memory 330. Subsequently at step H09, data representative of the quantity of printed outputs $N_{OUT}$ indicated in the numerical display window 228 in the control panel 196 in the first document supply unit 140*a* is stored as the data $D_{PQ/1}$ into the print quantity data memory area corresponding to address $D_1$ of the memory 330. The microprocessor unit 304 then proceeds to step H10 at which data representative of the size of original document currently indicated by any of the indicators 238*a* to 238*d* associated with the document size select key 236 on the control panel 196 in the first document supply unit 140*a* is stored as the data $D_{DSZ/1}$ into the document size data memory area corresponding to address $D_1$ of the memory 330.

Subsequently to step H10, the third microprocessor unit 304 returns to the main routine program described with reference to FIG. 14 and may proceed to the automatic copying order shifting subroutine program F04 included in the main routine program as will be hereinafter described with reference to FIG. 16.

Automatic Copying Order Shifting Subroutine Program (F04)

Figure 16:
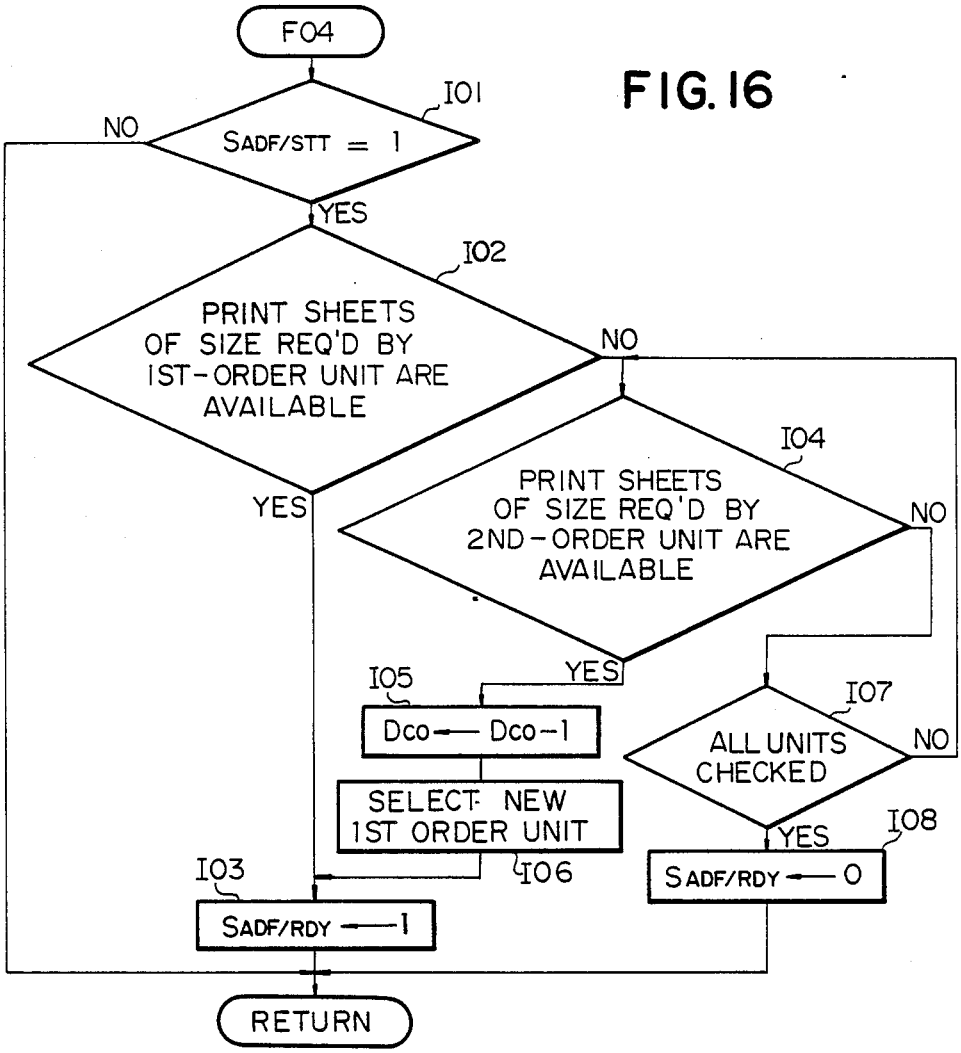
FIG. 16 is a flowchart showing the details of an automatic copying order shift control subroutine program also included in the main routine program illustrated in FIG. 12.

FIG. 16 shows the details of a preferred example of the automatic copying order shifting subroutine program F04 also included in the main routine program hereinbefore described with reference to FIG. 12.

As shown in FIG. 16, the automatic copying order shifting subroutine program F04 starts with a decision step I01 to check if the automatic document feed start signal $S_{ADF/STS}$ is set to logic "1" state. If the answer for this step I01 is given in the negative, the third microprocessor unit 304 returns to the main routine program of FIG. 12. If it is found at step I01 that the signal $S_{ADF/STS}$ has been set to logic "1" state, the step I01 is followed by another decision step I02 at which is detected whether or not print sheets of the size conforming to the product of multiplication of the selected size of the original document to be supplied from the first-order one of the document supply units 140a to 140c of the automatic document feed module 32 and the selected magnification ratio for copying are available in one of the print sheet supply cassettes 84 and 86 currently set in the duplicator module 30. If it is found at this step I02 that print sheets of such a required size are available in the lower or upper print sheet supply cassette 84 or 86, the third microprocessor unit 304 proceeds to step I03 to set the automatic document feed ready signal $S_{ADF/RDY}$ to logic "1" state. As has been noted, this automatic document feed ready signal $S_{ADF/RDY}$ of logic "1" state is effective to grant the first microprocessor unit 300 to output signals necessary for starting a cycle of copying operation.

If it is found at step I02 that print sheets of the required size are not available in any of the lower and upper print sheet supply cassettes 84 and 86, then the third microprocessor unit 304 proceeds to step I04 at which is detected whether or not print sheets of the size required by the original documents loaded into another, viz., the currently second-order one of the document supply units 140a to 140c are available in one of the print sheet supply cassettes 84 and 86 currently set in the duplicator module 30. If it is found at this step I04 that print sheets of such a required size are available in one of the print sheet supply cassettes 84 and 86, the third microprocessor unit 304 proceeds to step I05 to decrement the data $D_{CO}$ in the copying order data memory area for the current second-order document supply unit. The document supply unit which has been registered as the second-order document supply unit is now registered as a new first-order document supply unit. The step I05 is followed by step I06 at which the microprocessor unit 304 outputs a signal to select the new first-order document supply unit for use. Subsequently to step I06, the automatic document feed ready signal $S_{ADF/RDY}$ is set to logic "1" state also at step I03.

If it is found at step I03 that print sheets of the size required by the initial second-order document supply unit are available in one of the print sheet supply cassettes 84 and 86, then the third microprocessor unit 304 proceeds to step I07 to confirm if all the document supply units available, viz., the first, second and third automatic document feed module 32 of the apparatus under consideration have been checked for the presence of print sheets of the proper size. If it is detected at this step I07 that there still remains a document supply unit or document supply units to be checked for the presence of print sheets of the proper size, the loop of the steps I04 and I07 is repeated until the answer for the step I07 turns affirmative.

When the answer for the step I07 is thus given in the affirmative, the microprocessor unit 304 proceeds to step I08 to reset the automatic document feed ready signal $S_{ADF/RDY}$ to logic "0" state. Subsequently to the step I03 or step I08, the third microprocessor unit 304 returns to the main routine program described with reference to FIG. 12 and may proceed to the machine management control subroutine program F05 included in the main routine program as will be hereinafter described with reference to FIG. 17.

Machine Management Control Subroutine Program (F05)

Figure 17:
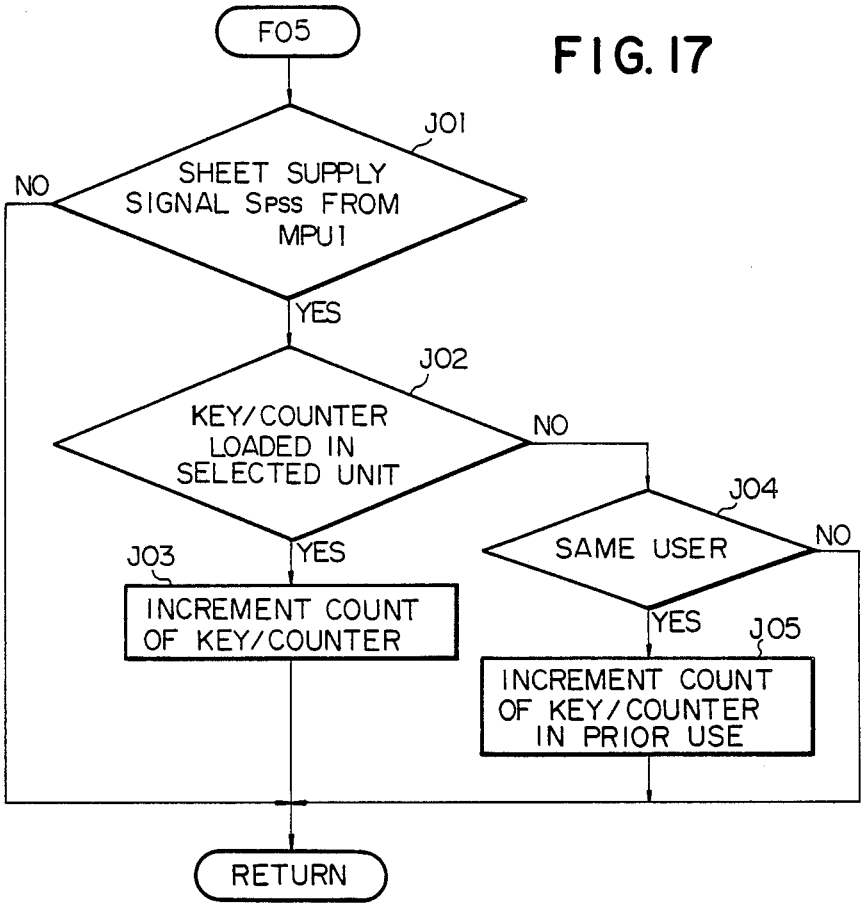
FIG. 17 is a flowchart showing the details of a machine management control subroutine program further included in the main routine program illustrated in FIG. 12.

FIG. 17 shows the details of a preferred example of the machine management control subroutine program F05 also included in the main routine program hereinbefore described with reference to FIG. 12.

The machine management control control subroutine program F05 starts with a decision step J01 at which is checked if there is a print sheet supply signal $S_{PSS}$ of a logic "1" state received from the first microprocessor unit 300 indicating that a print sheet has been supplied from the lower or upper print sheet supply cassette 84 or 86 of the duplicator module 30. In the absence of such a signal $S_{PSS}$ received from the first microprocessor unit 300, the third microprocessor unit 304 immediately returns to the main routine program of FIG. 12 without completing the present subroutine program F05.

If it is found at step J01 that there is a print sheet supply signal $S_{PSS}$ of logic "1" state received from the first microprocessor unit 300, it is further tested at step J02 whether or not the key/counter 190 (FIG. 3) is loaded into the currently selected one of the first, second and third document supply units 140a, 140b and 140c of the automatic document feed module 32. This test is made through detection of the signal $S_{KC}$ of logic "1" state which may be output from the key/counter load detector 194 provided in the selected document supply unit 140a, 140b or 140c. If the answer for the step J02 is given in the affirmative, the microprocessor unit 304 proceeds to step J03 to increment the count of printed outputs registered in the key/counter 190 loaded in the socket compartment 188 of the currently selected document supply unit.

As has been noted, the count of printed outputs registered in the key/counter 190 loaded in the socket compartment 188 of a currently selected document supply unit each time a printing step is terminated and a printed output produced from the apparatus. When a cycle of copying operation which may consist of a single printing step or a succession of printing steps is complete, the number of the printing steps repeated and counted by the management system after the key/counter 190 was loaded into the system is thus registered in the key/counter 190 and is displayed thereon. The number of the printing steps repeated during the cycle of copying operation just terminated is added to the number of the printing steps which had been registered in the key/counter 190 until the key/counter 190 was loaded into the socket compartment 188. Thus, the count in the key/counter 190 is incremented by a signal supplied from the count increment signal generator (not shown) provided in association with each of the document supply units 140a, 140b and 140c.

If, now, it is determined at step J02 that there is no key/counter 190 loaded into the currently selected one of the first, second and third document supply units 140a, 140b and 140c, it is detected at step J04 whether or not the user of the apparatus to whom the original document or the stack of original documents set in the selected document supply unit 140a, 140b or 140c belongs is identical with the user of the apparatus to whom the original document or the stack of the original documents set in the document supply unit which had been selected immediately before the currently selected document supply unit was selected. This test is made on the basis of the signal $S_{UI}$ of logic "1" state which may be output from the magnetic user identification sheet sensor 198 responsive to the user identification sheet placed on the original document or the stack of original documents set in the currently selected document supply unit.

When the answer for the step J04 is given in the affirmative, the microprocessor unit 304 proceeds to step J05 to increment the count of printed outputs registered in the key/counter 190 which was used for the copying of the original document or the stack of original documents set in the document supply unit which had been selected immediately before the currently selected document supply unit was selected. Subsequently to the step J03 or step J05 or when the answer for the step J04 is given in the negative, the third microprocessor unit 304 reverts to the main routine program described with reference to FIG. 12 and may proceed to the key/counter load display control subroutine program F06 included in the main routine program as will be hereinafter described with reference to FIG. 18.

Key/Counter Load Display Control Subroutine Program (F06)

Figure 18:
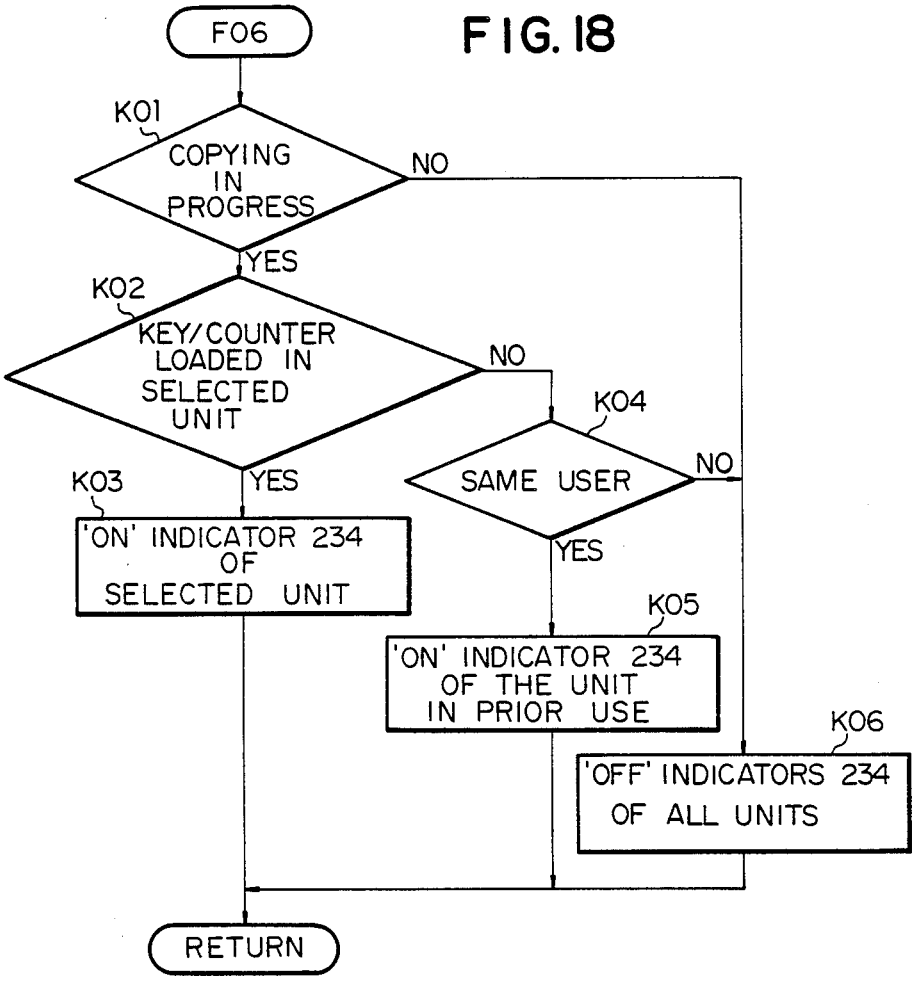
FIG. 18 is a flowchart showing the details of a key/counter load display control subroutine program further included in the main routine program illustrated in FIG. 12.

FIG. 18 shows the details of a preferred example of the key/counter load display control subroutine program F06 further included in the main routine program hereinbefore described with reference to FIG. 12.

As shown in FIG. 18, the key/counter load display control subroutine program F06 starts with a decision step K01 at which is checked if a cycle of copying operation is currently in progress in the apparatus. If the answer for this step K01 is given in the affirmative, it is further tested at step K02 whether or not the key/counter 190 is loaded into the currently selected one of the first, second and third document supply units 140*a*, 140*b* and 140*c* of the automatic document feed module 32. As is the case with the step J02 in the subroutine program described with reference to FIG. 17, this test is made through detection of the signal $S_{KC}$ of logic "1" state which may be output from the key/counter detector 194 provided in the selected document supply unit 140*a*, 140*b* or 140*c*.

If the answer for the step K02 is given in the affirmative, the microprocessor unit 304 proceeds to step K03 to output a signal to activate the key/counter load indicator 234 on the control panel 196 of the currently selected document supply unit. If it is determined at step K02 that there is no key/counter 190 loaded into the currently selected one of the first, second and third document supply units 140*a*, 140*b* and 140*c*, it is detected at step K04 whether or not the user of the apparatus to whom the original document or the stack of original documents set in the selected document supply unit 140*a*, 140*b* or 140*c* belongs is identical with the user of the apparatus to whom the original document or the stack of the original documents set in the document supply unit which had been selected immediately before the currently selected document supply unit was selected. This test is also made on the basis of the signal $S_{UI}$ of logic "1" state which may be output from the magnetic user identification sheet sensor 198 responsive to the user identification sheet placed on the original document or the stack of original documents set in the currently selected document supply unit. When the answer for the step K04 is given in the affirmative, the microprocessor unit 304 proceeds to step K05 to activate the key/counter load indicator 234 on the control panel 196 of the document supply unit which had been selected immediately before the currently selected document supply unit was selected. The steps K04 and K05 are useful in that, if copying operation is in progress with use of the currently selected document supply unit with the key/counter 190 loaded into another document supply unit, the operator is informed by the key/counter load indicator 234 of the other document supply unit that the key/counter 190 currently loaded into the particular document supply unit need not or should not be removed therefrom and re-loaded into the document supply unit currently in use.

When the answer for step K01 or step K04 is given in the negative, the third microprocessor unit 304 proceeds to step K06 to de-activate the key/counter load indicators 234 of all the document supply units 140*a*, 140*b* and 140*c*. The step K06 is thus followed when it is found at step K01 that there is no print sheet supply signal $S_{PSS}$ of a logic "1" state received from the first microprocessor unit 300 with no print sheet supplied from the lower or upper print sheet supply cassette 84 or 86, or when it is found at step K04 that the user of the apparatus to whom the original document or the stack of original documents set in the selected document supply unit belongs is not identical with the user to whom the original document or the stack of the original documents set in the document supply unit which had been selected immediately before the currently selected document supply unit was selected.

Subsequently to the step K03, step K05 or step K06, the third microprocessor unit 304 reverts to the main routine program described with reference to FIG. 12 and may proceed to the copying operation start grant control subroutine program F07 included in the main routine program as will be hereinafter described with reference to FIG. 19.

Copying Operation Start Grant Control Subroutine Program (F07)

Figure 19:
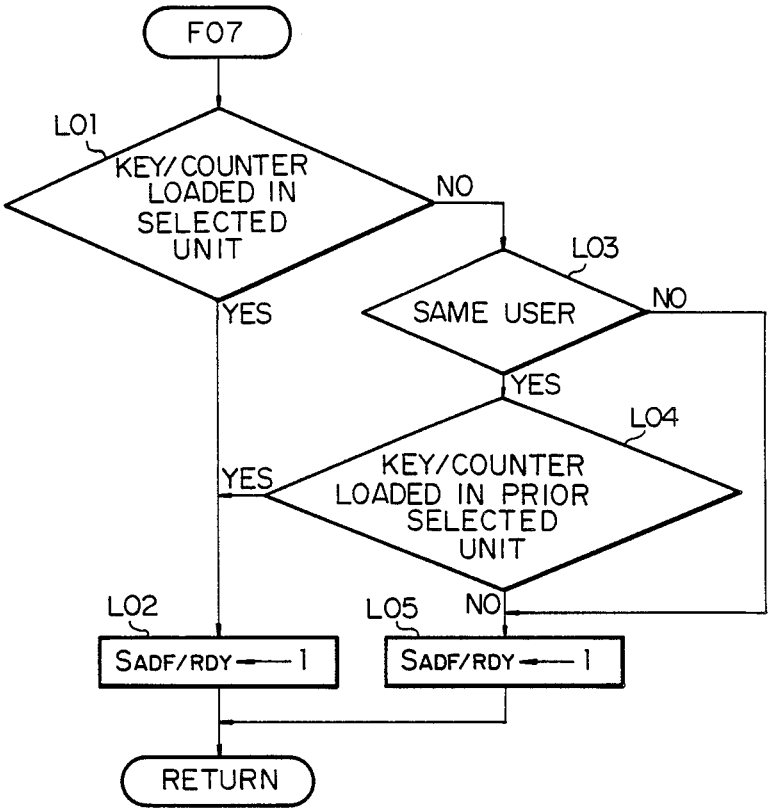
FIG. 19 is a flowchart showing the details of a copying operation start grant control subroutine program further included in the main routine program illustrated in FIG. 12.

FIG. 19 shows the details of a preferred example of the copying operation start grant control subroutine program F07 further included in the main routine program hereinbefore described with reference to FIG. 12.

As shown in FIG. 19, the copying operation start grant control subroutine program F07 starts with a decision step L01 at which is checked whether or not the key/counter 190 is loaded into the currently selected one of the first, second and third document supply units 140*a*, 140*b* and 140*c* of the automatic document feed module 32. If the answer for the step L01 is given in the affirmative, the microprocessor unit 304 proceeds to step L02 to set the automatic document feed ready signal $S_{ADF/RDY}$ to logic "1" state. As has been noted, this automatic document feed ready signal $S_{ADF/RDY}$ of logic "1" state is effective to grant the first microprocessor unit 300 to output signals necessary for starting a cycle of copying operation.

If it is determined at step L01 that there is no key/counter 190 loaded into the currently selected one of the first, second and third document supply units 140*a*, 140*b* and 140*c*, it is further detected at step L03 whether or not the user of the apparatus to whom the original document or the stack of original documents set in the selected document supply unit 140*a*, 140*b* or 140*c* belongs is identical with the user of the apparatus to whom the original document or the stack of the original documents set in the document supply unit which had been selected immediately before the currently selected document supply unit was selected. When the answer for this step M03 is given in the affirmative, the microprocessor unit 304 proceeds to step M04 to further test whether or not the key/counter 190 is loaded into the document supply unit which had been selected immediately before the currently selected document supply unit was selected. When the answer for this step L04 is given in the affirmative, the microprocessor unit 304 also proceeds to step L02 to set the automatic document feed ready signal $S_{ADF/RDY}$ to logic "1" state.

When the answer for the step L03 or step L04 is given in the negative, the microprocessor unit 304 proceeds to step L05 to reset the automatic document feed ready signal $S_{ADF/RDY}$ to logic "0" state. The step L05 is thus followed either when it is found at step L03 that the user of the apparatus to whom the original document or the stack of original documents set in the selected document supply unit belongs is not identical with the user to whom the original document or the stack of the original documents set in the document supply unit which had been selected immediately before the currently selected document supply unit was selected, or or when it is found at step L04 that the key/counter 190 is not loaded into the document supply unit which had been selected immediately before the currently selected document supply unit was selected.

Subsequently to the step L02 or step L05, the third microprocessor unit 304 reverts to the main routine program described with reference to FIG. 12 and may proceed to the automatic document feed control subroutine program F08 also included in the main routine program as will be hereinafter described with reference to FIGS. 20A and 20B.

Automatic Document Control Subroutine Program (F08)

Figure 20A:
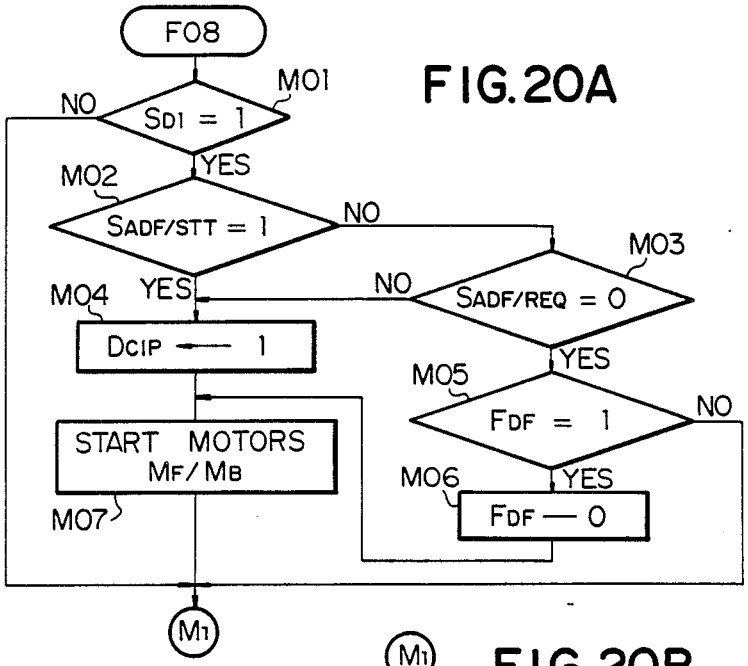
FIG. 20 is a flowchart showing the details of a document control subroutine program further included in the main routine program illustrated in FIG. 12.
Figure 20B:
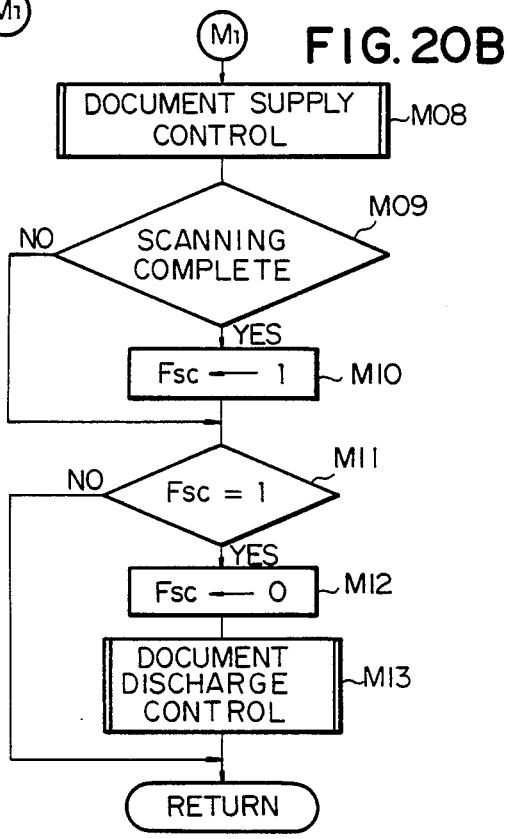

FIGS. 20A and 20B show the details of the automatic document control subroutine program F08 included in the main routine program described with reference to FIG. 12.

Referring to FIG. 20A, the automatic document control subroutine program F08 starts with a step M01 to check if the signal $S_{D1}$ from the document-on-tray sensor 182 in the currently selected document supply unit is of a logic "1" state with an original document placed on the document supply tray 148 of the currently selected one of the document supply units 140*a*, 140*b* and 140*c*. If it is found at this step M01 that there is the signal $S_{D1}$ of logic "1" state, the step M01 is followed by a step M02 which is responsive to the automatic document feed start signal $S_{ADF/STT}$. This automatic document feed start signal $S_{ADF/STT}$ is set to logic "1" state at step D06 of the copying operation control subroutine program A04 hereinbefore described with reference to FIGS. 10A to 10C and is relayed from the first microprocessor unit 300.

If it is found at step M02 that there is present no signal $S_{ADF/STT}$ of logic "1" state, then the step M02 is followed by step M03 to test whether or not an automatic document feed request signal $S_{ADF/REQ}$ of a logic "0" state is currently present. If it is found at this step M03 that there is not present such a signal $S_{ADF/REQ}$ of logic "0" state or it is found at step M02 that there is present an automatic document feed start signal $S_{ADF/STT}$ of logic "1" state, the microprocessor unit 304 proceeds to step M04 at which data of logic "0" value is stored as the data $D_{CIP}$ into the cycle-in-progress data memory area corresponding to the address of the memory 330 for the currently selected document supply unit.

When it is found at step M03 that there is present the signal $S_{ADF/REQ}$ of logic "0" state, it is further tested at step M05 whether or not a document feed flag $F_{DF}$ of a logic "1" state is currently present. If the answer for this step M05 is given in the affirmative, then the management system 304 proceeds to M06 to reset the document feed flag $F_{DF}$ to logic "0" state. The document feed flag $F_{DF}$ is used to control the feeding of the original document or each of the original documents subsequent to the first one of the original documents set in a document supply unit.

Subsequently to the step M04 or step M06, the third microprocessor unit 304 proceeds to step M07 to output instruction signals so that the roller drive motor 156 ($M_F$) in the currently selected document supply unit 140*a*, 140*b* or 140*c* and the belt drive motor 177 ($M_B$) in the document transport assembly 142 of the automatic document feed module 32 are initiated into operation. The belt drive motor 156 in the selected document supply unit being thus initiated into operation, the transport belt 176 is to be driven to have its lower travelling path portion moved forwardly to move the original document on the document support table 36 toward a predetermined exposure position on the table 36.

Subsequently to the step M07 or if the answer for the step M01 or step M05 is given in the negative, the third microprocessor unit 304 proceeds to a document supply control subroutine program M08 illustrated in FIG. 10B. This document feed control subroutine program M08 is executed to convey the original document in the document supply assembly 140 to a prescribed exposure position on the document support table 36 of the image duplicator module 30. The details of this document feed control subroutine program M08 will be hereinafter described with reference to FIG. 21.

After the document feed control subroutine program M08 has been executed, the third microprocessor unit 304 proceeds to step M09 to confirm whether or not the scanning of the original document on the document support table 36 has been repeated the required number of times. If the answer for this step M09 is given in the affirmative, then a scan complete flag $F_{SC}$ of a logic "1" state is raised at step M10. Subsequently to this step M10 or if it is found at the preceding step M09 that the scanning operation has not been repeated the preset number of times, then it is checked at step M11 whether or not the scan complete flag $F_{SC}$ of logic "1" state is present. If the answer for this step M11 is given in the affirmative, the scan complete flag $F_{SC}$ is reset to logic "0" state at step M12. The scan complete flag $F_{SC}$ is used to indicate whether the original documents of the quantity designated through the control panel 196 of the currently selected document supply unit have all been scanned by the document scanner 46/48 of the duplicator module 30.

Now that the scan complete flag $F_{SC}$ is found to be of logic "1" state and is thus reset to logic "0" state, the third microprocessor unit 304 proceeds to a document discharge subroutine program M13. The details of this document discharge subroutine program M17 will be hereinafter described with reference to FIG. 22. After the document discharge subroutine program M22 has been executed, the third microprocessor unit 304 reverts to the main routine program illustrated in FIG. 12 and may proceed to the subroutine program F09 of the main routine program.

Document Feed Control Subroutine Program (M08)

Figure 21:
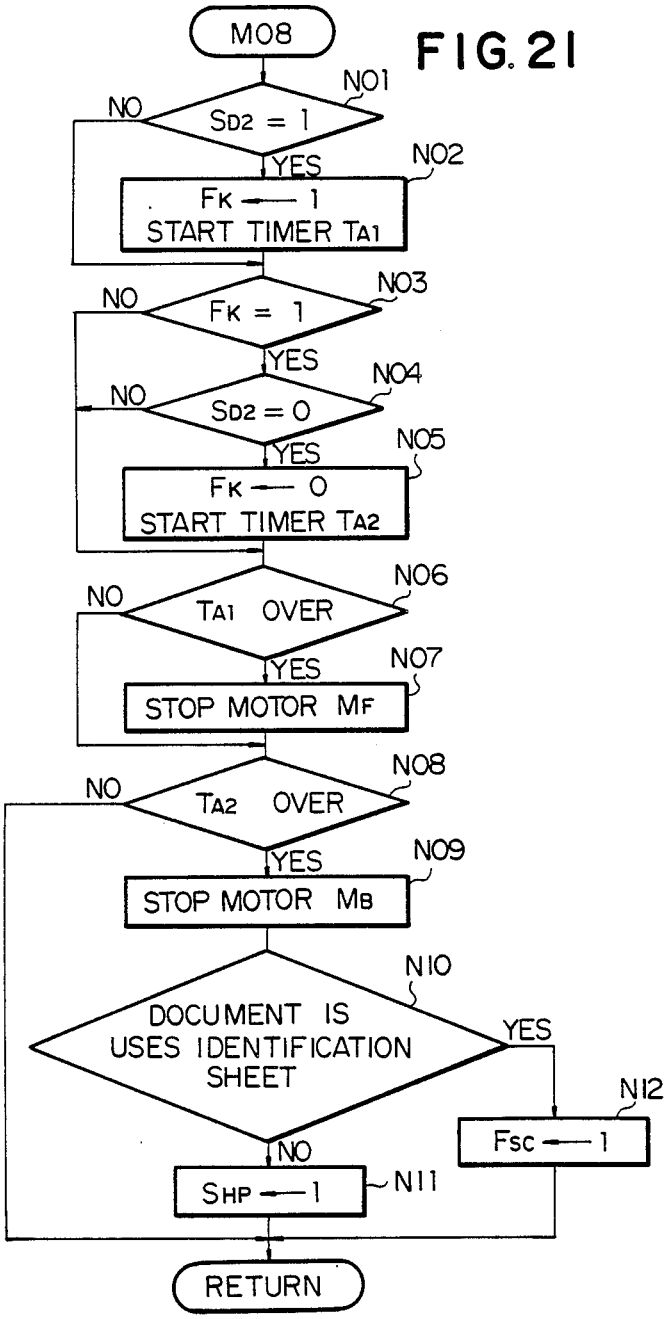
FIG. 21 is a flowchart showing the details of a document feed control subroutine program included in the document control routine program illustrated in FIG. 20.

FIG. 21 shows the document feed control subroutine program M08 included in the document control subroutine program F08 hereinbefore described with reference to FIGS. 20A and 20B.

Referring to FIG. 21, the document feed control subroutine M08 is executed to transport an original document to a correct exposure position on the document support table 36 of duplicator module 32 by means of the transport belt 176 of the document transport assembly 142. Such a subroutine program M09 starts with a step N01 at which is checked whether or not there is present the signal $S_{D2}$ of logic "1" state produced by the document-on-table sensor 184. If it is found at the step N01 that such a signal $S_{D2}$ is present, a flag "$_{FK}$" of, for example, a logic "1" state for memorizing the condition of the document-on-table sensor 184 is set at step N02 and at the same time a first system timer "$T_{A1}$" of the third microprocessor unit 304 is enabled to start counting operation at step N02. For this first system timer "$T_{A1}$" is set a period of time for which the roller drive motor 150 ($M_F$) in the currently selected document supply unit 140a, 140b or 140c is to remain operative. The roller drive motor 150 being actuated into operation at step M07 of the subroutine program F08, the original document which has been loaded into the currently selected document supply unit is driven to travel forwardly into the document transport assembly 142 until the sheet is brought into contact with the travelling transport belt 176.

Subsequently to the step N02 or if it is found at the preceding step N01 that there is no signal $S_{D2}$ of logic "1" state output from the document-on-table sensor 184, it is detected at step N03 whether or not hte flag "$F_K$" of logic "1" state is present. If the answer for this step N03 is given in the affirmative, it is further queried at step N04 whether or not there is a signal $S_{D2}$ of logic "0" state output from the document-on-table sensor 184. If it is found at this step N04 that such a signal is present, the flag "$F_K$" is reset to a logic "0" state and at the same time a second system timer "$T_{A2}$" of the microprocessor unit 304 is enabled to start counting operation at step N05. For this second system timer "$T_{A2}$" is set a time when the original document travelling forwardly on the document support table 36 reaches a position having its trailing end at the rearmost end of the correct exposure position on the document support table 36. Subsequently to the step N05 or if it is found at the preceding step N03 that there is no flag "$F_K$" present or at the step N04 that there is no signal $S_{D2}$ of logic "0" state output from the document-on-table sensor 184, the third microprocessor unit 304 proceeds to step N06 to check whether or not the time preset for the first system timer "$T_{A1}$" has lapsed. If the answer for this step N06 is given in the affirmative, then the third microprocessor unit 304 issues an instruction to de-energize the roller drive motor 156 ($M_F$) in the currently selected document supply unit 140a, 140b or 140c at step N07. Subsequently to this step N07 or if it is found at the preceeding step N06 that the counting operation by the first system timer "$T_{A1}$" is still in progress, it is tested at step N08 whether or not the time preset for the second system timer "$T_{A2}$" has lapsed. If the answer for this step N08 is given in the affirmative, then the belt drive motor 177 ($M_B$) actuated into operation at step M07 of the subroutine program F08 is brought to a stop at step N09.

Subsequently to step N09, it is confirmed at step N10 whether or not the original document being currently handled is a user identification sheet. If the answer for this step N10 is given in the negative, the home position signal $S_{HP}$ to be relayed to the first microprocessor unit 300 is set to logic "1" state at step N11. If it is found at step N10 that the original document being currently handled is a user identification sheet, the scan complete flag $F_{SC}$ is set to logic "1" state at step N12 so that the user identification sheet is to be discharged without being duplicated. Subsequently to the step N11 or step N12 or if it is found at the preceding step N08 that the second system timer "$T_{A2}$" is still in operation, the third microprocessor unit 304 reverts to the subroutine program F08 described with reference to FIGS. 20A and 20B and may proceed to the step M09 thereof.

Document Discharge Control Subroutine Program (M13)

Figure 22A:
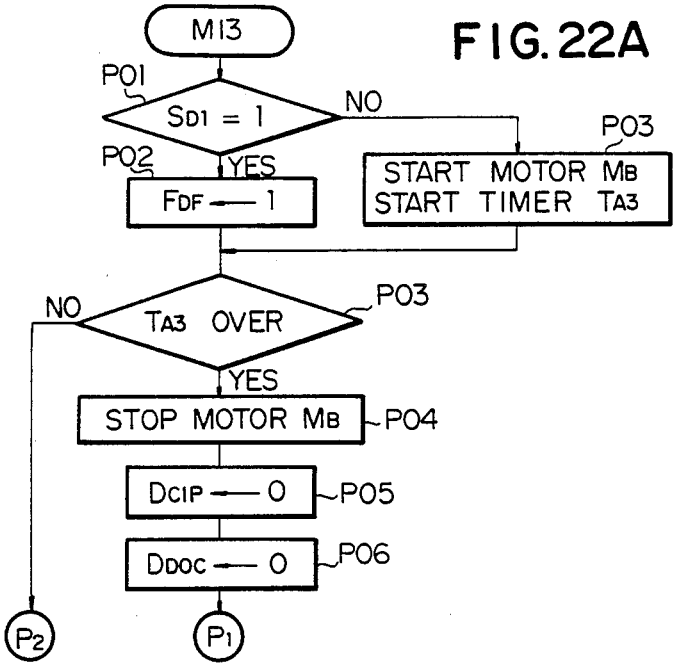
FIG. 22 is a flowchart showing the details of a document discharge control subroutine program also included in the document control routine program illustrated in FIG. 20.
Figure 22B:
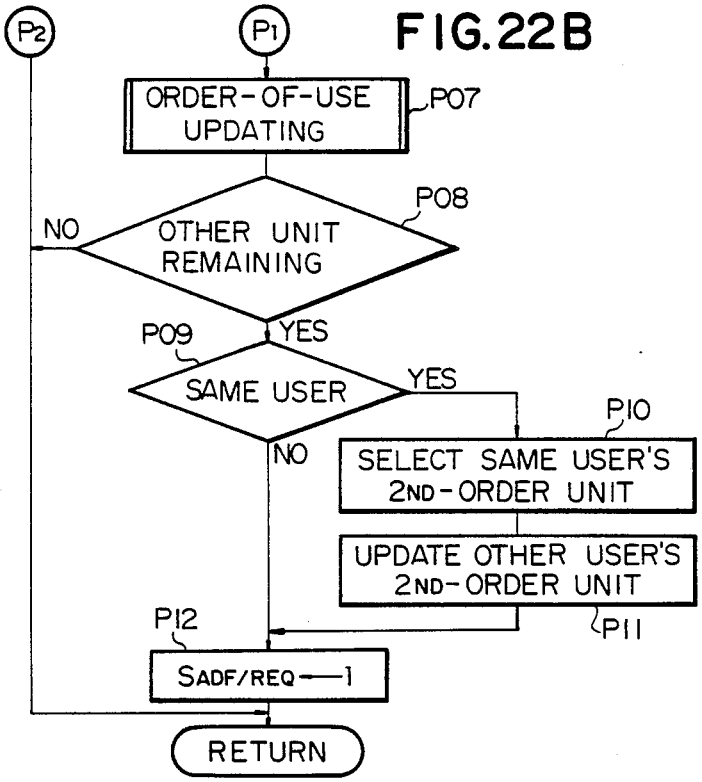

FIGS. 22A and 22B show the document discharge control subroutine program M13 included in the document control subroutine program F08 described with reference to FIGS. 10A and 10B.

In the document discharge control subroutine M13 is first confirmed at step P01 whether or not there is an original document placed in the currently selected document supply unit 140a, 140b or 140c. This confirmation is made on the basis of the signal $S_{D1}$ supplied from the document-on-tray sensor 182 in the currently selected document supply unit 140a, 140b or 140c. If it is found at this step P02 that there is an original document in the currently selected document supply unit, the document feed flag $F_{DF}$ of logic "1" state is set at step P02.

If it is determined at step P01 that the signal $S_{D1}$ from the document-on-tray sensor 184 in the currently selected document supply unit is of a logic "0" state, then the belt drive motor 177 ($M_B$) in the document transport assembly 142 is actuated for rotation in the forward direction as at step P03 so that the original document on the document support table 36 is driven by the transport belt 176 for forward movement on the table 36. At this step P03 is also activated a third system timer "$T_{A3}$" of the microprocessor unit 304. For this third system timer "$T_{A3}$" is set the time for which an original document of possibly the largest standardized size that may be placed on the support table 36 will be allowed to move on and leave the document support table 36.

Either the step P02 or the step P03 is followed by a step P04 at which is checked whether or not the third system timer "$T_{A3}$" has terminated its counting operation. If it is found at step P04 that this is not the case, the microprocessor unit 304 reverts to the subroutine program F08 of FIGS. 10A and 10B. If it is found at the step P04 that the counting operation is still in progress in the third system timer "$T_{A3}$", the microprocessor unit 304 proceeds to step P05 to output a signal to de-energize the belt drive motor 177 and bring the motor 177 to a stop. Thereafter, the microprocessor unit 304 proceeds to step P06 at which data of logic "0" value is stored as the data $D_{CIP}$ into the cycle-in-progress data memory area corresponding to the address of the memory 330 for the currently selected document supply unit. At step P07 subsequent to this step P06, data of logic "0" value is stored as the data $D_{DOC}$ into the document presence/absence data memory area corresponding to the address of the memory 330 of the currently selected document supply unit.

Subsequently to step P07, the third microprocessor unit 304 proceeds to subroutine program P08 shown in FIG. 22B, through which the order of use for each of the document supply units which remain to be used is decremented upon termination of the copying operation for all the original documents supplied from the currently selected document supply unit. There being three document supply units 140a, 140b and 140c in the automatic document feed module 32, the order of use represented by the data $D_{CO}$ in the copying order data memory area for the current second-order document supply unit is updated to the first order and, similarly, the order of use represented by the data $D_{CO}$ in the copying order data memory area for the current third-order document supply unit is updated to the second order, upon termination of the copying operation for all the original documents supplied from the current first-order document supply unit. The details of this order-of-use updating subroutine program P08 will be hereinafter described with reference to FIG. 23.

Upon termination of the order-of-use updating subroutine program P08, the microprocessor unit 304 proceeds to a decision step P09 to check if there is another or "second-order" document supply unit having an original document or a stack of original documents stored therein. If the answer for this step P09 is given in the affirmative, it is further checked at step P10 if there is the second-order document supply unit occupied by an original document or a stack of original documents belonging to the same user of the apparatus to whom the original document or the original documents supplied from the current first-order document supply unit belongs. If the answer for this step P10 is also given in the affirmative, the step P10 is followed by step P11 at which the microprocessor unit 304 outputs a signal to select the particular second-order document supply unit for use in the immediately subsequent cycle or cycles of copying operation. If, in this instance, the document supply unit thus selected as the second-order document supply unit happens to have been registered as the third-order document supply unit with the other user's document supply unit registered as the second-order document supply unit, the other user's second-order document supply unit is registered as a new third-order document supply unit as at step P12. If the document supply unit selected as the second-order document supply unit at step P11 happens to have been registered as the second-order document supply unit, the microprocessor unit 304 jumps over step P11.

Subsequently to this step P12 or when it is determined at step P10 that there is the same user's second-order document supply unit, the microprocessor unit 304 proceeds to step P13 to set the automatic document feed request signal $S_{ADF/REQ}$ to logic state "1". Subsequently to the step P13 or if it is found at the preceding step P04 that the third system, timer "$T_{A3}$" of the microprocessor unit 304 is still in operation, the microprocessor unit 304 reverts to the automatic document control subroutine program F08 described with reference to FIGS. 10A and 10B and may proceed to the routine program F09 of the main routine program of FIG. 12.

Order-of-Use Updating Subroutine Program (P08)

Figure 23:
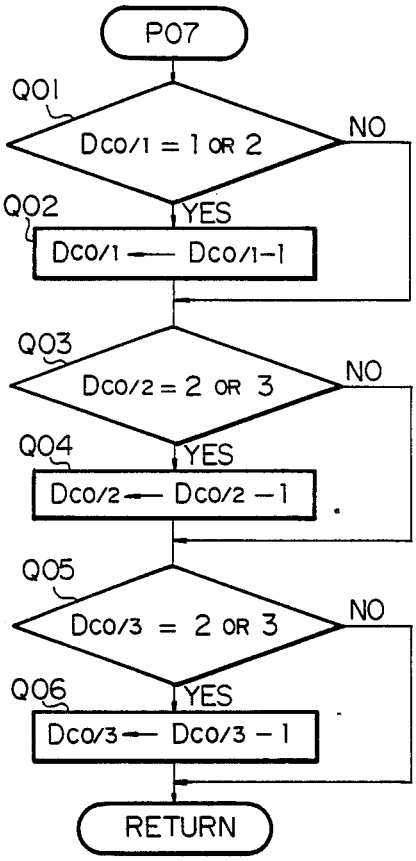
FIG. 23 is a flowchart showing the details of an order-of-use updating subroutine program included in the document discharge control routine program illustrated in FIG. 22.

FIG. 23 is a flowchart showing the details of the order-of-use updating subroutine program P08 included in the document discharge control routine program M13 described with reference to FIG. 22.

The order-of-use updating subroutine program P08 starts with a decision step Q01 at which is checked whether or not the data $D_{CO/1}$ in the copying order data memory area for the first document supply unit 140*a* of the automatic document feed module 32 is indicative of the second or third order of use. If the answer for this step Q01 is given in the affirmative, the data is updated so that the order of use represented by the data $D_{CO/1}$ in the copying order data memory area for the first document supply unit 140*a* is decremented to the first order of use.

If the answer for the step Q01 is given in the negative or subsequently to the step Q02, the third microprocessor unit 304 proceeds to step Q03 to check whether or not the data $D_{CO/2}$ in the copying order data memory area for the second document supply unit 140*b* of the automatic document feed module 32 is indicative of the second or third order of use. If the answer for this step Q03 is given in the affirmative, the data is updated so that the order of use represented by the data $D_{CO/2}$ in the copying order data memory area for the second document supply unit 140*b* is decremented to the first order of use.

If the answer for the step Q03 is also given in the negative or subsequently to the step Q04, the third microprocessor unit 304 proceeds to step Q03 to check whether or not the data $D_{CO/3}$ in the copying order data memory area for the third document supply unit 140*c* of the automatic document feed module 32 is indicative of the second or third order of use. If the answer for this step Q03 is given in the affirmative, the data is updated so that the order of use represented by the data $D_{CO/3}$ in the copying order data memory area for the second document supply unit 140*c* is decremented to the first order of use.

If the answer for the step Q05 is also given in the negative or subsequently to the step Q06, the third microprocessor unit 304 reverts to the document discharge control subroutine program M13 described with reference to FIGS. 22A and 22B and may proceed to step P09 of the subroutine program M13.

While it has been hereinbefore described that the machine management system incorporated in the apparatus embodying the present invention is of the type using a key/counter, any of other types of machine management system similarly effective may be adopted in a duplicating apparatus according to the present invention, such as a machine management system using an integrated-circuit (IC) card, a magnetic card, or the like.

As will have been appreciated from the foregoing description, one of the advantages of an image duplicating apparatus according to the present invention resides in that, when one of the document supply units provided in the automatic document feed module 32 is in operation with the key/counter loaded into any one of the document supply units, a visual signal is indicated on the control panel of the document supply unit in operation although the key/counter may be loaded into another document supply unit. This is useful particularly when another user's key/counter happens to be set in the document supply unit currently used by the operator because the operator is informed of the fact that there is the document supply unit remaining to be used after operation with the document supply unit which the operator has been using is terminated. Thus, the operator of the apparatus is precluded from removing the other user's key/counter from the document supply unit when the operation with the document supply unit which the operator has been using is terminated. If desired, a suitable locking mechanism may be provided for the socket compartment of each of the document supply units so that the key/counter loaded into a document supply unit or any of the key/counters loaded into two or more of the document supply units could not be removed therefrom until copying operation is complete for all of the original documents set in the automatic document feed module 32.

Another advantages of an image duplicating apparatus according to the present invention results from the use of a user identification sheet in combination with the machine management system. The use of such a user identification sheet allows the operator of the apparatus to select two or more of the document supply units by inserting the user's key/counter into any one of the document supply units rather than inserting a key/counter into each of the individual document supply units selected for use. The user identification sheet for use in the apparatus proposed by the present invention is typically of the magnetically detectable type but, if desired, a document supply unit of any other type such as an optically detectable document supply unit using, for example, bar codes or any other graphical pattern may be used in substitution for a user identification sheet of the magnetic type. To inform the apparatus that the original documents set in two or more of the document supply units belong to the same user of the apparatus, a suitable switch or key may be provided in each of the document supply units if further desired.

What is claimed is:

1. An image duplicating apparatus comprising (a) image reproducing means for reproducing an image on an original document held in a predetermined position within the apparatus, (b) a plurality of document supply means each operative to supply an original document therefrom, (c) document transport means for transporting the original document supplied from any of said document supply means to said predetermined position and discharging the original document from the predetermined position after the image on the original document is reproduced by said image reproducing means, and (d) management means including means for locking the apparatus in an inoperative condition, said management means and further including (d/1) a plurality of enabling means respectively associated with said plurality of document supply means and each operative to enable the apparatus to operate with an original document supplied from the associated document supply means, each of said plurality of enabling means including an unlocking signal generating means for generating an unlocking signal for unlocking the apparatus.

2. An image duplicating apparatus comprising (a) image reproducing means for reproducing an image on an original document held in a predetermined position within the apparatus, (b) a plurality of document supply means each operative to supply an original document therefrom, (c) document transport means for transporting the original document supplied from any of said document supply means to said predetermined position and discharging the original document from the predetermined position after the image on the original document is reproduced by said image reproducing means, and (d) management means including means for locking the apparatus in an operative condition, said management means further comprising (d/1) a plurality of enabling means respectively associated with said plurality of document supply means and each operative to enable the apparatus to operate with an original document supplied from the associated document supply means, (d/2) a casing forming part of each of said enabling means, (d/3) unlocking means operable for unlocking the apparatus when brought into engagement with the casing of any one of said plurality of enabling means, and (d/4) detecting means for detecting the engagement established between said unlocking means and the casing of any of said plurality of enabling means.

3. An image duplicating apparatus as set forth in claim 2, further comprising (e) control means for clearing said inoperative condition of said apparatus when the presence of said unlocking means engaging with the casing of any one of said plurality of enabling means is detected by said detecting means.

4. An image duplicating apparatus as set forth in claim 3, in which said control means is adapted to allow operation of a particular one of said document supply means when the presence of said unlocking means engaging with the casing of the enabling means associated with the particular one of the document supply means is detected by said detecting means, and prohibit operation of a particular one of said document supply means when the absence of said unlocking means engaging with the casing of the enabling means associated with the particular one of the document supply means is detected by said detecting means.

5. An image duplicating apparatus as set forth in claim 2, further comprising output producing means for producing a printed output having a printed image reproduced by said image reproducing means from an original document supplied from any of said plurality of document supply means, said unlocking means comprising memory means for storing the accumulated quantity of printed outputs produced by said output producing means for the original documents supplied from the document supply means or document supply means having the casing or casings of the associated enabling means which have been engaged by the locking means after said memory means is reset for the last time.

6. An image duplicating apparatus as set forth in claim 5, in which said control means is further operative to increment said accumulated quantity of printed outputs each time a printed output is produced by said output producing means.

7. An image duplicating apparatus comprising (a) image reproducing means for reproducing an image on an original document held in a predetermined position within the apparatus, said image reproducing means forming part of a main duplicator unit, (b) a plurality of document supply means each operative to supply an original document therefrom, each of said plurality of document supply means being detachably coupled to said main duplicator unit, (c) document transport means for transporting the original document supplied from any of said document supply means to said predetermined position and discharging the original document from the predetermined position after the image on the original document is reproduced by said image reproducing means, and (d) management means comprising (d/1) a plurality of enabling means respectively associated with said plurality of document supply means and each operative to enable the appratus to operate with an original document supplied from the associated document supply means.

8. An image duplicating apparatus as set forth in claim 7, in which said plurality of enabling means of said management means are disposed within said plurality of document supply means, respectively.

9. An image duplicating apparatus as set forth in claim 7, in which each of said document supply means comprises (b/1) a document outlet port for delivering an original document therefrom, (b/2) first means for passing an original document through said document delivery port, (b/3) a document inlet port for receiving an original document delivered through the document outlet port of another document supply means, and (c/4) second means for conveying an original document from the document inlet port to the document outlet port of the document supply means per se.

10. An image duplicating apparatus as set forth in claim 9, in which said each of said document supply means further comprises (b/5) connecting means for connecting each of the document supply means to another document supply means with the document outlet port of one of the document supply means is located close to and in alignment with the document inlet port of another document supply means.

11. An image duplicating apparatus comprising (a) image reproducing means for reproducing an image on an original document held in a predetermined position within the apparatus, (b) a plurality of document supply means each operative to supply an original document therefrom, (c) document transport means for transporting the original document supplied from any of said document supply means to said predetermined position and discharging the original document from the predetermined position after the image on the original document is reproduced by said image reproducing means, (d) management means operable for locking the apparatus in an inoperative condition and comprising (d/1) a plurality of enabling means respectively associated with said plurality of document supply means and each operative to enable the apparatus to operate with an original document supplied from the associated document supply means.

(d/2) unlocking means operable for unlocking the apparatus when brought into engagement with any one of said plurality of enabling means, (d/3) detecting means for detecting the engagement established between said unlocking means and any of said plurality of enabling means, (e) control means for clearing said inoperative condition of said apparatus when the presence of said unlocking means engaging with the casing of any one of said plurality of enabling means is detected by said detecting means, (f) output producing means for producing a printed output having a printed image reproduced by said image reproducing means from an original document supplied from any of said plurality of document supply means, (g) said unlocking means comprising memory means for storing the accumulated quantity of printed outputs produced by said output producing means for the original documents supplied from the document supply means or document supply means having the casing or casings of the associated enabling means which have been engaged by the locking means after said memory means is reset for the last time, and (h) incrementing means operative to increment said accumulated quantity of printed outputs each time a printed output is produced by said output producing means.

12. An image duplicating apparatus as set forth in claim 11, in which said control means is adapted to prohibit operation of a particular one of said document supply means when the absence of said unlocking means engaging with the casing of the enabling means associated with the particular one of the document supply means is detected by said detecting means.

13. An image duplicating apparatus as set forth in claim 12, further comprising (i) associating means through which the uncoupling means currently engaging the enabling means associated with a first one of said document supply means is to be operatively associated with a second one of the document supply means.

14. An image duplicating apparatus as set forth in claim 13, in which said control means is further operative to allow said second one of the document supply means with said unlocking means held in engagement with the enabling means of said first one of the document supply means.

15. An image duplicating apparatus as set forth in claim 14, in which said incrementing means is operative to increment said accumulated quantity of printed outputs each time a printed output is produced by said output producing means from an original document supplied from said first one of the document supply means with said unlocking means held in engagement with the enabling means of said first one of the document supply means.

16. An image duplicating apparatus as set forth in claim 15, in which each of said enabling means comprises indicating means for indicating that said incrementing means is in operation for incrementing said accumulated quantity of printed outputs.

17. An image duplicating apparatus as set forth in claim 13, in which said associating means comprises (i/1) sheet means to be located within said second one of said document supply means, and (i/2) said sheet means within said second one of the document supply means.

18. A management method for managing an image duplicating apparatus which has image reproducing means for reproducing an image on an original document held in a predetermined position, a plurality of document supply means each operative to supply an original document therefrom, and document transport means for transporting the original document supplied from any of said document supply means to said predetermined position, said management method comprising the steps of:

providing a plurality of management units respectively associated with said plurality of document supply means, locking the apparatus in an inoperative condition when all of said management units are inactive, and unlocking the appratus, when any one of said management units is active, to operate with an original document supplied from the associated document supply means.

* * * * *